US008800228B2

(12) United States Patent
Holmgren

(10) Patent No.: US 8,800,228 B2
(45) **Date of Patent: *Aug. 12, 2014**

(54) SCULPTED ROOM SYSTEM

(71) Applicant: Sculpted Room Design LLC, St. Paul, MN (US)

(72) Inventor: David A. Holmgren, St. Paul, MN (US)

(73) Assignee: Sculpted Room Design, LLC, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/179,784

(22) Filed: Feb. 13, 2014

(65) Prior Publication Data

US 2014/0157683 A1 Jun. 12, 2014

Related U.S. Application Data

(63) Continuation-in-part of application No. 13/524,231, filed on Jun. 15, 2012, now Pat. No. 8,667,753.

(60) Provisional application No. 61/498,204, filed on Jun. 17, 2011.

(51) Int. Cl.

| | |
|---|---|
| ***E04F 13/00*** | (2006.01) |
| ***E04F 19/00*** | (2006.01) |
| ***E04C 2/38*** | (2006.01) |
| ***E04F 19/04*** | (2006.01) |

(52) U.S. Cl.

CPC . *E04C 2/388* (2013.01); *E04C 2/38* (2013.01); *E04F 19/0436* (2013.01); *E04F 2019/0454* (2013.01)

USPC ..... 52/311.2

(58) Field of Classification Search

CPC ..... E04C 2/38; E04C 2/384; E04C 2/388; E04C 2002/00; E04C 2002/3444; E04B 9/00; E04B 9/045; E04B 9/0457; E04F 19/0436; E04F 2019/0454

USPC ..... 52/311.1, 311.2, 311.3, 312, 287.1, 52/288.1, 506.01, 506.06–506.09, 309.4

See application file for complete search history.

(56) References Cited

U.S. PATENT DOCUMENTS

| | | | | | |
|---|---|---|---|---|---|
| 3,819,466 | A | * | 6/1974 | Winfield et al. | 428/175 |
| 3,841,958 | A | * | 10/1974 | Delorme | 28/117 |
| 4,052,830 | A | * | 10/1977 | Smith | 52/288.1 |
| 4,283,894 | A | * | 8/1981 | Raty | 52/311.1 |
| 4,726,973 | A | * | 2/1988 | Thompson | 428/45 |
| 4,748,781 | A | * | 6/1988 | Wencley | 52/309.5 |

(Continued)

*Primary Examiner* — Mark Wendell

*Assistant Examiner* — Keith Minter

(74) *Attorney, Agent, or Firm* — James L. Young; Westman, Champlin & Koehler, P.A.

(57) ABSTRACT

In one aspect, a system is disclosed including a plurality of modules configured for attachment to a mounting surface. A first module includes a panel and a plurality of structural elements extending from an interior surface of the panel. The panel has a decorative major surface disposed opposite the interior surface and comprises a plurality of edges that form a closed shape. At least some of the plurality of structural elements are positioned proximate the plurality of edges. An attachment surface of the plurality of structural elements is positioned opposite the interior surface, and the attachment surface is configured to abut the mounting surface or to abut an attachment surface of another module for attachment thereto. A method of modifying a mounting surface of a room includes attaching a first module to the mounting surface. In another aspect, a method of creating a room partition is disclosed.

19 Claims, 36 Drawing Sheets

(56) References Cited

U.S. PATENT DOCUMENTS

| | | | | | |
|---|---|---|---|---|---|
| 4,808,457 | A * | 2/1989 | Kruck et al. | 428/69 |
| 4,914,883 | A * | 4/1990 | Wencley | 52/309.5 |
| 5,007,226 | A * | 4/1991 | Nelson | 52/784.15 |
| 5,819,485 | A * | 10/1998 | Lane et al. | 52/287.1 |
| 5,897,932 | A * | 4/1999 | McGarth et al. | 428/69 |
| 6,117,514 | A * | 9/2000 | Herrmann | 428/81 |
| 6,251,497 | B1 * | 6/2001 | Hoopingarner et al. | 428/158 |
| 6,253,510 | B1 * | 7/2001 | Santarossa | 52/287.1 |
| 6,260,329 | B1 * | 7/2001 | Mills | 52/794.1 |
| 6,659,020 | B1 * | 12/2003 | Ball | 108/57.28 |
| 6,715,246 | B1 * | 4/2004 | Frecska et al. | 52/220.6 |
| 6,723,419 | B2 * | 4/2004 | Rogers | 428/158 |
| 7,757,449 | B2 * | 7/2010 | Portoles Ibanez et al. | 52/384 |
| 7,871,040 | B2 * | 1/2011 | Lee et al. | 244/119 |
| 2005/0166506 | A1 * | 8/2005 | Morelissen et al. | 52/506.06 |
| 2006/0179782 | A1 * | 8/2006 | Cox | 52/653.1 |
| 2009/0064620 | A1 * | 3/2009 | Launs | 52/506.06 |
| 2010/0229475 | A1 * | 9/2010 | Myers et al. | 52/173.1 |
| 2010/0307089 | A1 * | 12/2010 | Cox | 52/309.4 |

* cited by examiner

SCULPTED ROOM SYSTEM

CROSS REFERENCE TO RELATED APPLICATION

This application is a continuation-in-part of U.S. patent application Ser. No. 13/524,231, filed Jun. 15, 2012, which in turn claims the benefit of priority from U.S. Provisional Patent Application Ser. No. 61/498,204, filed Jun. 17, 2011, which are hereby incorporated by reference in their entirety.

BACKGROUND

The present disclosure relates to building construction and interior design and in particular to a construction system of components, with shared properties, that can be arranged, shaped and modified to create interior ceiling and wall designs.

The current practice of interior room construction involves the use of framing members arranged to be finished with substrate materials. These procedures involve much expertise and labor. Accordingly, designs involving "set-out" construction in the form of drop and multi-level ceilings as well as soffits, decorative accent walls and room partition elements are time consuming and expensive to create.

The present disclosure describes a system of components that, when installed alone or in combination, will enable relatively easy fabrication of such "set-out" construction as well as custom walls and room partition elements.

SUMMARY

In one aspect, a system is disclosed comprising a plurality of modules configured for attachment to a mounting surface. A first module of the plurality of modules comprises a panel and a plurality of structural elements extending from an interior surface of the panel. The panel has a decorative major surface disposed opposite the interior surface and comprises a plurality of edges that form a closed shape. At least some of the plurality of structural elements are positioned proximate the plurality of edges. An attachment surface of the plurality of structural elements is positioned opposite the interior surface, and the attachment surface is configured to abut the mounting surface or to abut an attachment surface of another module for attachment thereto.

In another aspect, a method of creating a room partition is disclosed, the method comprising joining first and second modules at the first and second attachment surfaces. The first module comprises a first panel having a first decorative major surface disposed opposite a first interior surface and a first structural element extending from the first interior surface and at least partially bordering a first cavity. A first attachment surface is a surface of the first structural element opposite the first interior surface. The ; and second module comprises a second panel having a second decorative major surface disposed opposite a second interior surface and a second structural element extending from the second interior surface and at least partially bordering a second cavity. The second attachment surface is a surface of the second structural element opposite the second interior surface.

In yet another aspect, a method of modifying a mounting surface of a room comprises abutting a first attachment surface of a first module to the mounting surface and attaching the first module to the mounting surface. The first module comprises a first panel having a first decorative major surface disposed opposite a first interior surface; and a first structural element extending from the first interior surface and at least partially bordering a first cavity, wherein the first attachment surface is a surface of the first structural element opposite the first interior surface.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views.

Figure 1:
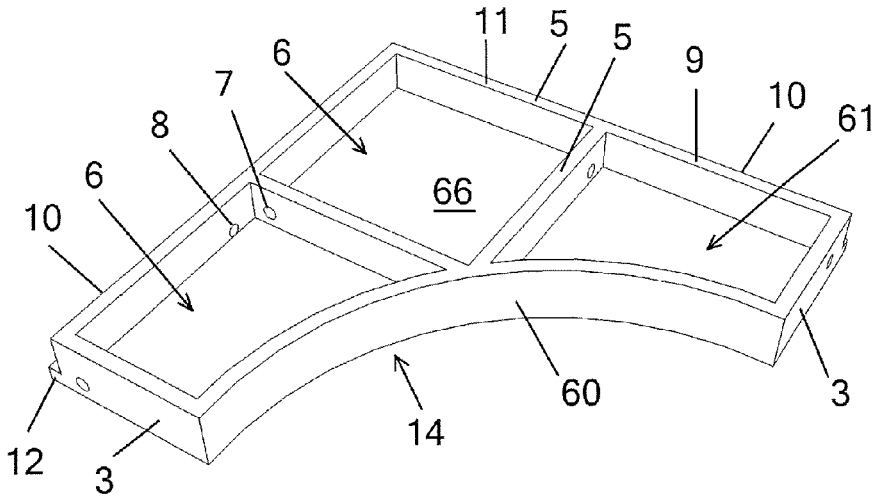
FIG. 1 is a top perspective view of an exemplary corner module component of an exemplary sculpted room system.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise.

DETAILED DESCRIPTION

The present disclosure is directed to a system of multi-dimensioned, web-structured, molded or fabricated components for the modification of room or building designs. In some exemplary embodiments, the components are made from a foam material including, but not limited to, lightweight, LEED-compliant, isocyanate polyurethane, non-isocyanate polyurethane, acrylic-based non-isocyanate polyurethane, high performance phenolic, high temperature polyisocyanurate, expanded polystyrene (EPS) or extruded polystyrene foam. Code ratings need to be met or exceeded in these materials and fabrication. In an exemplary embodiment, components are encapsulated with polymer-modified gypsum-based special hard coatings modified with ignition barrier material.

Many of the system's components utilize a web design for strength and light weight. In exemplary embodiments, each module is integrally formed, meaning that the panel and structural web elements of a module are formed as a single unit. In other embodiments, the panel and web elements are formed separately and then joined.

The disclosed system is useful for decorative positioning, as well as accommodating installation of lighting, media and security systems, and covering fire sprinkler, plumbing, wiring systems and other features. The system's components have variable modification, assembly and positioning capabilities that enable the construction of traditional or contemporary interior room designs.

An exemplary embodiment of a sculpted room system includes, but is not limited to, component modules configured for attachment to a mounting surface such as a ceiling or wall. Exemplary modules include but are not limited to a corner module 14, 114, 214, 314, a straight module 15, 115 a corner designer module 17, a straight designer module 18, a corner recessed curtain module 20, 320, a straight recessed curtain module 21, 321, a transition module 16, a radius module 19 and a design panel 22. All of these components can be arranged alone or in any variety of placement combinations, assembled, modified or unmodified, and executed to achieve desired ceiling and/or wall designs. Many of the modules are generally ceiling-positioned components, while the design panel 22 can be used, modified or unmodified, on a ceiling, wall, or as a partition or decorative accent wall extending along or at an angle to an existing wall. For example, one might align a series of modules along the ceiling perimeter for a full or partial soffit. In another application, a designer may incorporate the use of a shape-modified design panel 22 on a wall with a series of shaped design panels in a ceiling arrangement, with a transition module 16 therebetween. Another example positions shaped design panels 22 across a ceiling surface to create a drop-ceiling effect, with added shaped design panels 22 to incorporate a multi-level design. In an exemplary embodiment, any exposed surface, except the gluing or "attachment" surface of the system components, is a decorative surface.

The module and panel components of the exemplary sculpted room system share a web structure that creates a cavity or plurality of cavities in which lighting, security, and media systems can be placed. Other common properties of the system include, for example, the use of fire rated materials, as well as the addition of an ignition barrier material coating. In an exemplary embodiment, such an ignition barrier material coating is applied, during manufacture or separately, to all surfaces of each system component. After modification, any exposed "core" surface can be recoated to retain the structural integrity and fire protection of the component.

A component may also be laminated with a panel finishing sheet such as one made of magnesium oxide for high-temperature applications. In an exemplary embodiment, the materials of the system are LEED compliant. When in use, the means of attachment to an existing ceiling or wall is determined by component size and placement. In some cases, a module may be attached only by structural adhesive. In other cases, such as where a design panel 22 is used in a whole-ceiling design with multi-level elements, mechanical fasteners and inserts may be used in addition to structural adhesive. The components may be shaped as desired by a designer; the design drives the placement and assembly requirements.

The system of the disclosure provides a construction design system whose components have variable placement and modification capabilities. In an exemplary embodiment, components of a system share the same material and lightweight structural web. The system's common component structure allows for placement to cover or accommodate installed lighting, fire sprinkler, media, security systems, and other features. The system uses fire-rated, code- and LEED-compliant and environmentally friendly materials. In an exemplary embodiment, an additional ignition barrier coating material is used for fire protection.

The system components can be installed, assembled, modified or unmodified. Cavities of the design panel can be selectively filled to create a finished edge surface on an intended cut line. Alternatively, cut design panels can be finished by attaching edge finishing material across open cavities. Components of the system can be used alone or in combination to build three-dimensional interior finishing elements. Any of the components may also be laminated with a panel finishing sheet such as one made of magnesium oxide for high-temperature applications. In the illustrated embodiments, the depth of all of the sculpted room system components is shown as 4 inches, including any coatings. However, it is contemplated that other sizes of components may also be used.

Figure 2:
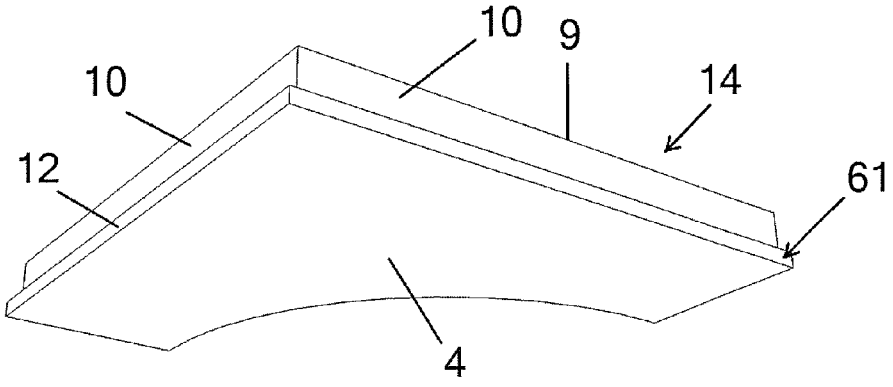
FIG. 2 is a bottom perspective view of the corner module component of FIG. 1.

FIGS. 1 and 2 show perspective top and bottom views, respectively, of an exemplary a corner module 14. Corner module 14 includes panel 61 having decorative major surface 4 opposite interior surface 66. Structural web elements 5 extend from interior surface 66 of panel 61, thereby defining accessory cavities 6 on interior surface 66. Accessory cavities 6 are at least partially bordered by structural web elements 5. An attachment surface 11 (in this case, the attachment surface 11 is the ceiling facing surface 9) of the structural web element 5 is configured to abut a mounting surface such as an existing wall 1 or an existing ceiling 2 (see FIG. 6) or another module (see, e.g., FIG. 37, where attachment surfaces of opposed module pairs 14, 14, and 15, 15 are abutted). At least two modules are configured for adjacent attachment to the mounting surface so that their decorative major surfaces 4 are co-extensive at a joint 28 between the two modules (see FIG. 6). In an exemplary embodiment, this is accomplished by manufacturing the modules with a shared depth dimension.

Structural web elements 5 form crossings, equally spaced in an exemplary embodiment, of corner module 14. Thus, in an exemplary embodiment, some of the plurality of accessory cavities 6 are identically sized. In an exemplary embodiment, structural web element 5 has apertures therethrough, including drain holes 8 and wire run access holes 7. As exhibited in FIGS. 31 and 32, accessory cavities 6 accommodate the installation of light fixtures 38 on the interior surface 66 of the cavity, to which electrical wiring 37 can be run through custom-cut wire-run access holes 7. Returning to FIGS. 1 and 2, the perimeter of corner module 14 is formed by five surfaces: two wall facing surfaces 10, joined at right angles to each other; two joining surfaces 3; and a curved decorative edge surface 60. In an exemplary embodiment, curved decorative edge surface 60 is an exterior face of a structural web element 5. In an exemplary embodiment, at least one exterior face of a structural web element 5 is a joining surface at a joint 28 (shown in FIG. 6) between a corner module 14 and another module. In use, a wall facing surface 10 can also be a joining surface if corner module 14 abuts another module at the wall facing surface 10.

An extension of panel 61 beyond structural web element 5 in at least one direction forms a trim edge 12. In the illustrated embodiment, panel 61 extends beyond structural web elements 5 in two orthogonal directions, and thus trim edge 12 runs along the two wall facing surfaces 10. Trim edge 12 can be trimmed for alignment of the modules or to accommodate irregular original construction of the room, for example. Attachment of the module to an existing ceiling in an exemplary embodiment is accomplished with structural adhesive applied to the attachment surface 11. Exemplary variable placement capabilities of corner module 14 are illustrated in FIGS. 6, 18, 19, 31 and 32. Standard, though non-limiting, dimensions of corner module 14 are as follows: a length of each joining surface 3, including trim edge 12, is about twelve inches; a length of each wall facing surface 10 is about 36 inches; curved decorative edge surface 60 is an arc for a circle having a 24 inch radius; the depth, a perpendicular distance between decorative major surface 4 and the attachment surface 11, is about four inches; and the thickness of the panel 61 is about one inch.

Figure 3:
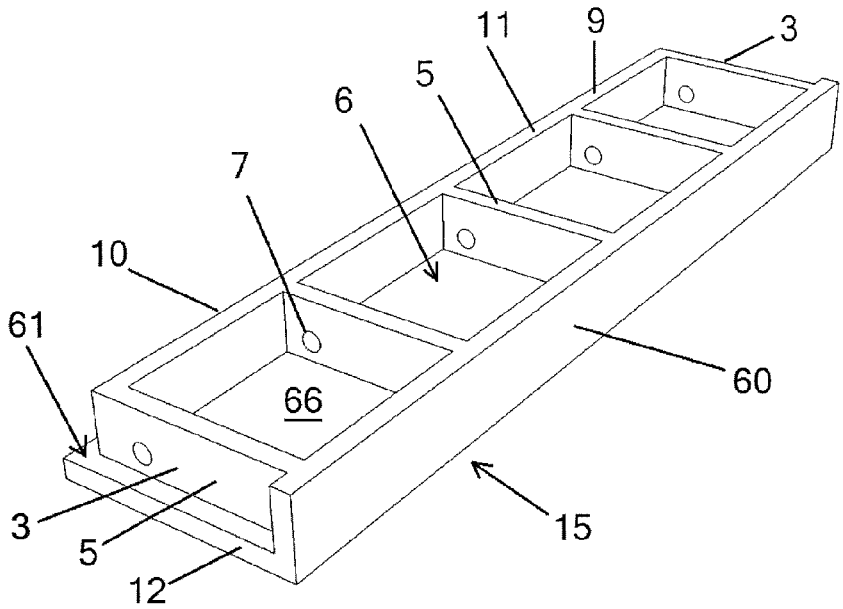
FIG. 3 is a top perspective view of an exemplary straight module component of an exemplary sculpted room system.
Figure 4:
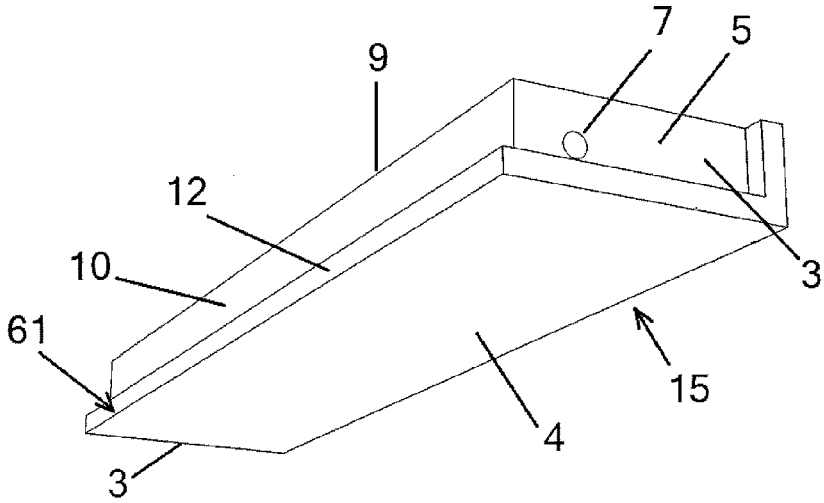
FIG. 4 is a bottom perspective view of the straight module component of FIG. 3.

FIGS. 3 and 4 show perspective top and bottom views, respectively, of a straight module 15. Straight module 15 includes panel 61 having decorative major surface 4 opposite interior surface 66. Structural web elements 5 extend from interior surface 61, thereby defining accessory cavities 6 on interior surface 66. Accessory cavities 6 are at least partially bordered by structural web elements 5. An attachment surface 11 (in this case, the attachment surface 11 is on ceiling facing surface 9) of the structural web element 5 is configured to abut an existing wall 1 or an existing ceiling 2 (see FIG. 6) or the attachment surface 11 of another module (see FIG. 37). At least two modules are configured for adjacent attachment to the mounting surface so that their decorative major surfaces 4 are co-extensive at a joint 28 between the two modules (see FIG. 6). In an exemplary embodiment, this is accomplished by manufacturing the modules with a shared depth dimension.

Structural web elements 5 form crossings, equally spaced in an exemplary embodiment, of straight module 15. As exhibited in FIGS. 31 and 32, accessory cavities 6 accommodate the installation of light fixtures 38 on the interior surface 66 of the cavity, to which electrical wiring 37 can be run through custom-cut wire-run access holes 7. Returning to FIGS. 3 and 4, the perimeter of straight module 15 is formed by four surfaces: a wall facing surface 10; an edge decorative surface 60; and two joining surfaces 3, arranged parallel to each other. In use, a wall facing surface 10 can also be a joining surface if straight module 15 abuts another module. An extension of panel 61 beyond a structural web element 5 forms a trim edge 12, which runs along wall facing surface 10. Trim edge 12 can be trimmed for alignment of the modules or to accommodate irregular original construction of the room, for example. In use, joining surface 3 may face a joining surface of an adjacent module but in some cases will not contact the other joining surface, depending on the extent to which trim edge 12 is trimmed. Attachment of the module to an existing ceiling in an exemplary embodiment is accomplished with structural adhesive applied to the attachment surface 11. Exemplary variable placement capabilities of corner module 14 are illustrated in FIGS. 6, 18, 19, 31, 32 and 43. Standard, though non-limiting, dimensions of corner module 14 are as follows: a length of each joining surface 3, including trim edge 12, is about twelve inches; a length of wall facing surface 10 (including the trim edges 12 at each end), is about 48 inches; a length of edge decorative surface 60 is about 48 inches; the depth, a perpendicular distance between decorative major surface 4 and the attachment surface 11, is about four inches; and the thickness of panel 61 is about one inch.

Figure 5:
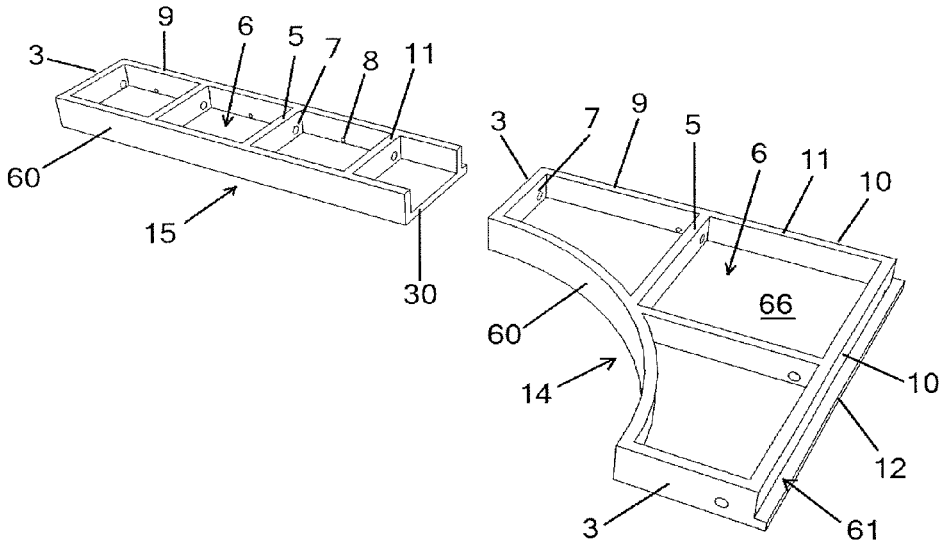
FIG. 5 is a top perspective view of the straight module component of FIGS. 3 and 4 and the corner module component of FIGS. 1 and 2, showing a modified component application.

FIG. 5 is a top perspective view of a straight module 15 modified for placement next to a corner module 14. Material has been removed from the length of straight module 15 to create a trimmed joining surface 30, to fit room dimensions when used in a ceiling perimeter soffit application. In an exemplary embodiment, after modification, any exposed "core" is re-coated to retain the structural integrity and fire protection of straight module 15.

Figure 6:
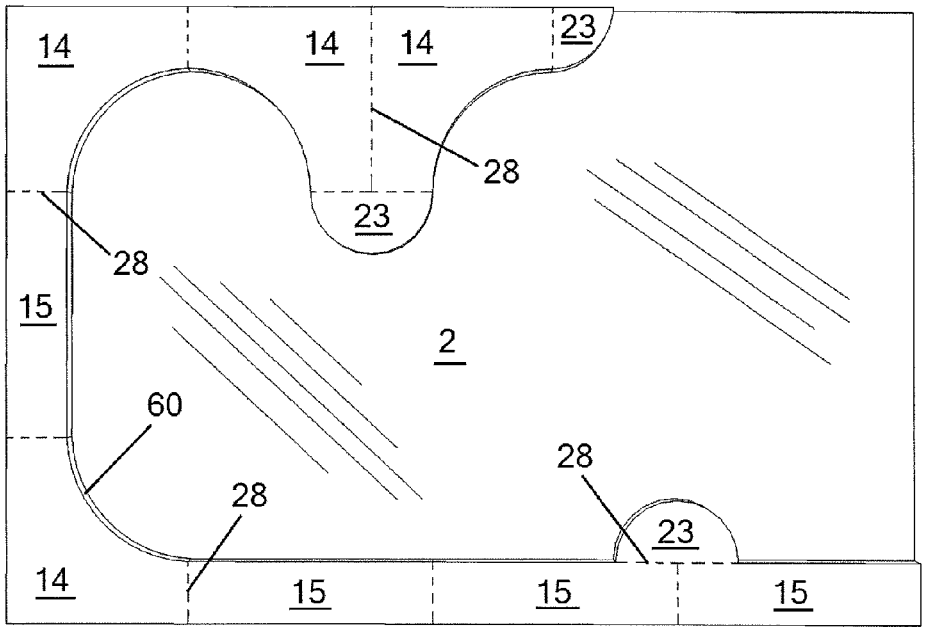
FIG. 6 is a bottom plan view of the exemplary corner and straight module components arranged on a ceiling, exhibiting multiple options of component placement.

FIG. 6 is a bottom plan view of a ceiling perimeter soffit arrangement using corner modules 14 and straight modules 15. This drawing further illustrates the variable positioning capabilities of the corner module 14, wherein its wall facing surface 10 is used as a joining surface. This variable surface positioning can also be achieved with straight module 15 and other components of this disclosure. The addition of special design elements 23, with shared component properties, completes this exemplary application. In assembly execution, the components are first positioned on the ceiling perimeter with decorative major surface 4 facing down, as shown, using double sided tape. Any sizing issues related to wall dimensions are resolved by trimming a straight module 15 perpendicular to its length. Any alignment problems are resolved by trimming a trim edge 12. Systems for lighting, media and security are then installed in the components, as exhibited in FIGS. 31 and 32. Once placement is finalized, structural adhesive is applied to attachment surfaces 11, and the modules are placed permanently in position, with attachment surfaces 11 in contact with existing ceiling 2. Finishing, such as by painting, for example, is then completed. Components of the disclosed system, such as corner module 14 and straight module 15 can also be positioned on an existing wall to create further design configurations.

Figure 7:
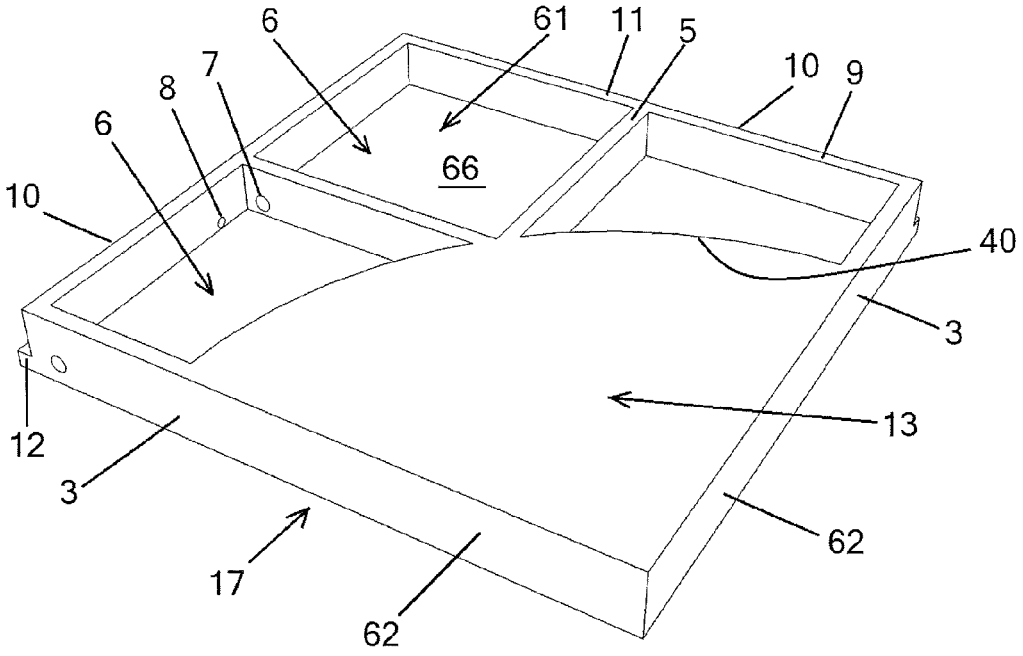
FIG. 7 is a top perspective view of a second exemplary embodiment of a corner module component of an exemplary sculpted room system.
Figure 8:
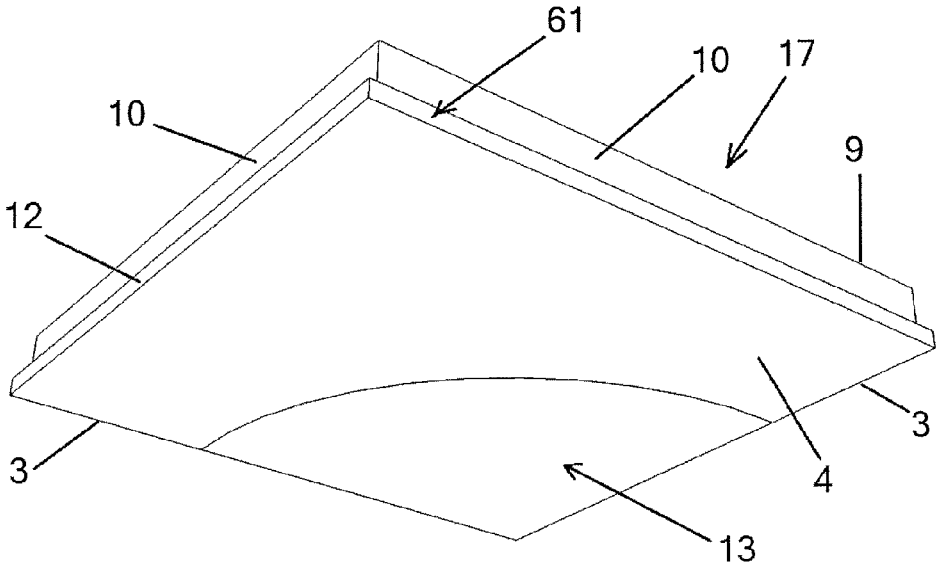
FIG. 8 is a bottom perspective view of the corner module component of FIG. 7.

FIGS. 7 and 8 show perspective top and bottom views, respectively, of a corner designer module 17. Corner designer module 17 includes panel 61 having decorative major surface 4 opposite interior surface 66. Structural web elements 5 extend from interior surface 61, thereby defining accessory cavities 6 on interior surface 66. Accessory cavities 6 are at least partially bordered by structural web element 5. An attachment surface 11 (in this case, the attachment surface 11 is on ceiling facing surface 9) of the structural web element 5 is configured to abut an existing wall 1 or an existing ceiling 2 (see FIGS. 13A, 13B) or the attachment surface 11 of another module (see FIG. 37). At least two modules are configured for adjacent attachment to the mounting surface so that their decorative major surfaces 4 are co-extensive at a joint 28 between the two modules (see FIGS. 13A, 13B). In an exemplary embodiment, this is accomplished by manufacturing the modules with a shared depth dimension.

Structural web elements 5 form crossings, equally spaced in an exemplary embodiment, of corner designer module 17. Shapeable portion 13 is defined at edge 40 and includes an area wherein decorative major surface 4 is disposed opposite attachment surface 11 with no cavities therebetween. The perimeter of corner designer module 17 is formed by four surfaces: two wall facing surfaces 10, joining each other at a right angle; and two shapeable decorative edge surfaces 62, joining each other at a right angle. In use, a wall facing surface 10 can also be a joining surface if corner designer module 17 abuts another module. An extension of panel 61 beyond a structural web element 5 forms a trim edge 12, which runs along each wall facing surface 10. Trim edge 12 can be trimmed for alignment of the modules or to accommodate irregular original construction of the room, for example. Attachment of the module to an existing ceiling in an exemplary embodiment is accomplished with structural adhesive applied to the attachment surface 11.

Corner designer module 17 is designed to have its shapeable portion 13 custom cut per application. Consequently, its use in combination with additional custom cut designer modules 17 and 18 can form a special design ceiling perimeter soffit assembly, as exhibited in FIGS. 13A and 13B. In an exemplary embodiment, the shapeable portions 13 of designer modules 17 and 18 comprise solid portions of material so that cutting results in a finished designed surface 29 at a cut line(s) positioned anywhere on shapeable portions 13. Examples of further variable placement capabilities of corner designer module 17 are illustrated in FIGS. 6, 18, 19, 31 and 32. Standard, though non-limiting, dimensions of corner designer module 17 are as follows: a length of each joining surface 3, including trim edge 12 and shapeable portion 13, is about 36 inches; a length of each wall facing surface 10 (including the trim edges 12), is about 36 inches; the depth, a perpendicular distance between decorative major surface 4 and the attachment surface 11, is about four inches; and the thickness of panel 61 is about one inch. After modification, any exposed "core" surface can be re-coated to retain the structural integrity and fire protection of the component.

Figure 9:
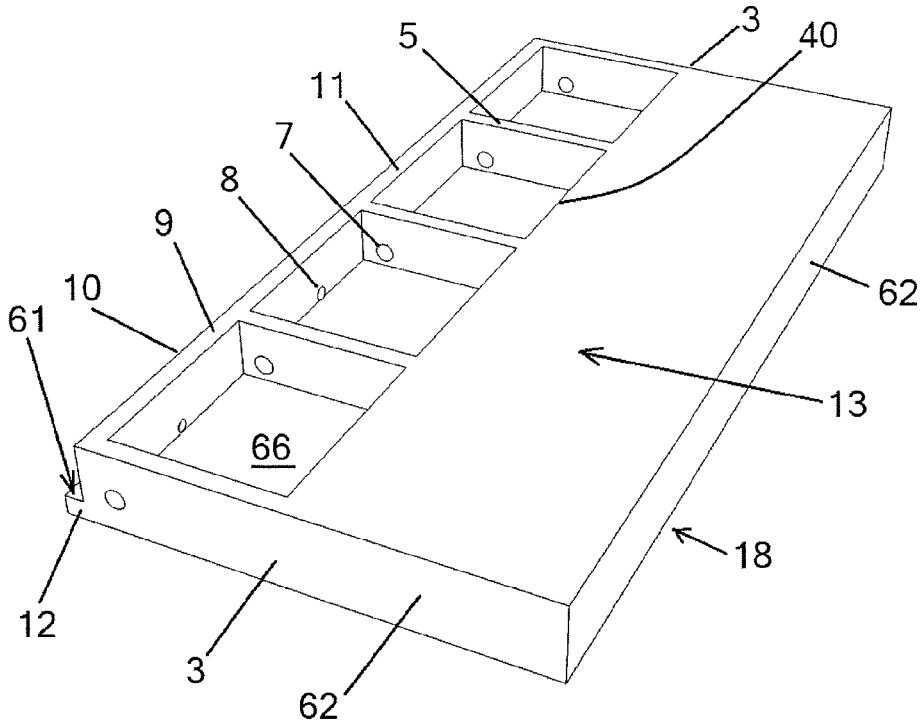
FIG. 9 is a top perspective view of a second exemplary embodiment of a straight module component of an exemplary sculpted room system.
Figure 10:
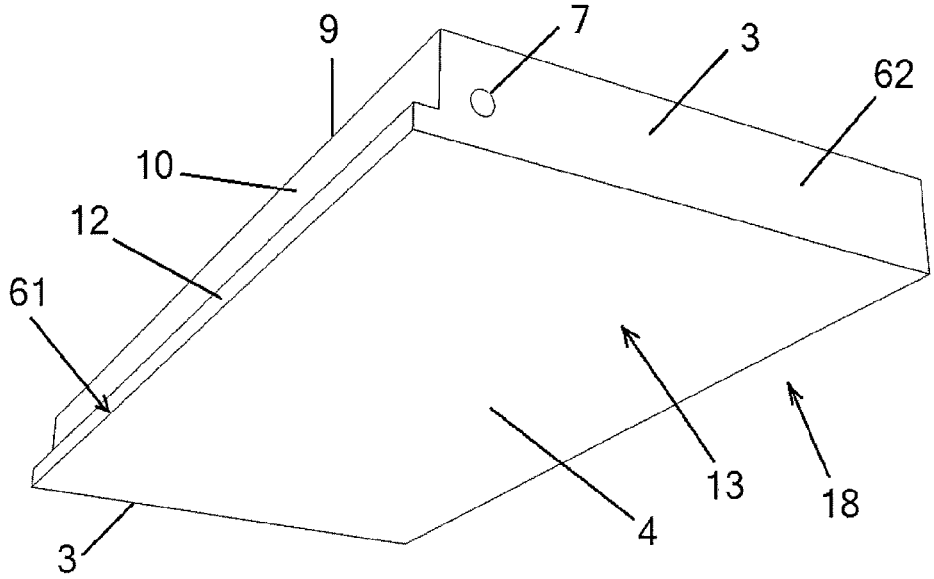
FIG. 10 is a bottom perspective view of the straight module component of FIG. 9.

FIGS. 9 and 10 show perspective top and bottom views, respectively, of a straight designer module 18. Straight designer module 18 includes panel 61 having decorative major surface 4 opposite interior surface 66. Structural web elements 5 extend from interior surface 61, thereby defining accessory cavities 6 on interior surface 66. Accessory cavities 6 are at least partially bordered by structural web element 5. An attachment surface 11 (in this case, the attachment surface 11 is on ceiling facing surface 9) of the structural web element 5 is configured to abut an existing wall 1 or an existing ceiling 2 (see FIGS. 13A, 13B) or the attachment surface 11 of another module (see FIG. 37). At least two modules are configured for adjacent attachment to the mounting surface so that their decorative major surfaces 4 are co-extensive at a joint 28 between the two modules (see FIGS. 13A, 13B). In an exemplary embodiment, this is accomplished by manufacturing the modules with a shared depth dimension.

Structural web elements 5 form crossings, equally spaced in an exemplary embodiment, of straight designer module 18. Shapeable portion 13 is defined at edge 40. The perimeter of straight designer module 18 is formed by four surfaces: one wall facing surface 10; one shapeable decorative edge surface 62; and two joining surfaces 3, which are parallel to each other. In use, a wall facing surface 10 can also be a joining surface if straight designer module 18 abuts another module. An extension of panel 61 beyond a structural web element 5 forms a trim edge 12, which runs along the wall facing surface 10. Trim edge 12 can be trimmed for alignment of the modules or to accommodate irregular original construction of the room, for example. Attachment of the module to an existing ceiling in an exemplary embodiment is accomplished with structural adhesive applied to the attachment surface 11.

Straight designer module 18 is designed to have its shapeable portion 13 custom cut per application. Consequently, its use in combination with additional custom cut designer modules 17 and 18 can form a special design ceiling perimeter soffit assembly, as exhibited in FIGS. 13A and 13B. Examples of further variable placement capabilities of straight designer module 18 are illustrated in FIGS. 6, 18, 19, 31 and 32. Standard, though non-limiting, dimensions of corner designer module 17 are as follows: a length of each joining surface 3, including trim edge 12 and shapeable portion 13, is about 24 inches; a length of wall facing surface 10 is about 48 inches; a length of shapeable decorative edge surface 62 is about 48 inches; the depth, a perpendicular distance between decorative major surface 4 and the attachment surface 11, is about four inches; and the thickness of panel 61 is about one inch. After modification, any exposed "core" surface should be re-coated to retain the structural integrity and fire protection of the component.

Figure 11:
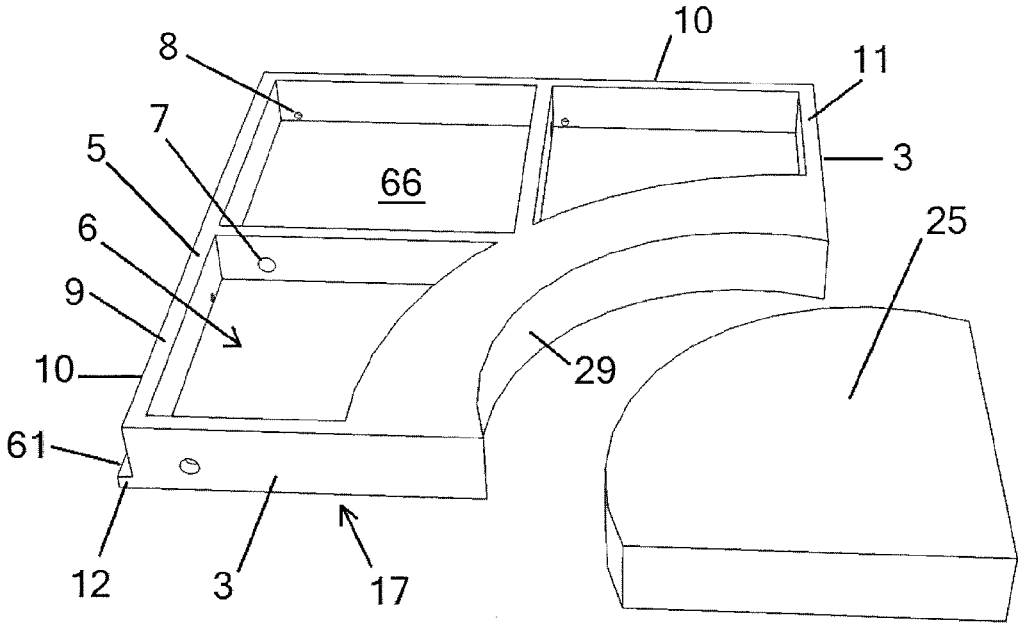
FIG. 11 is a top perspective view of the corner module component of FIGS. 7 and 8, exhibiting removed material for design execution.
Figure 12:
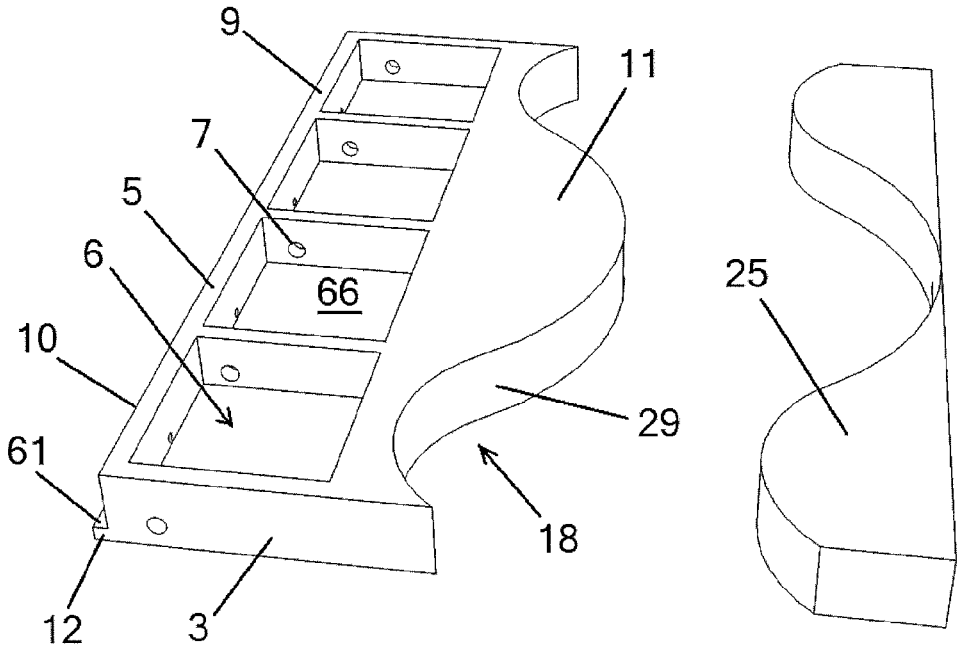
FIG. 12 is a top perspective view of the straight module component of FIGS. 9 and 10, exhibiting removed material for design execution.

FIGS. 11 and 12 show perspective top views, respectively, of a corner designer module 17 and a straight designer module 18 with removed material 25 separated from the components to reveal newly exposed designed surfaces 29. This process is further illustrated in FIGS. 13A and 13B. After modification, any exposed "core" surface, such as designed surface 29 revealed by cutting shapeable portion 13, can be re-coated to retain the structural integrity and fire protection of the component.

Figure 13A:
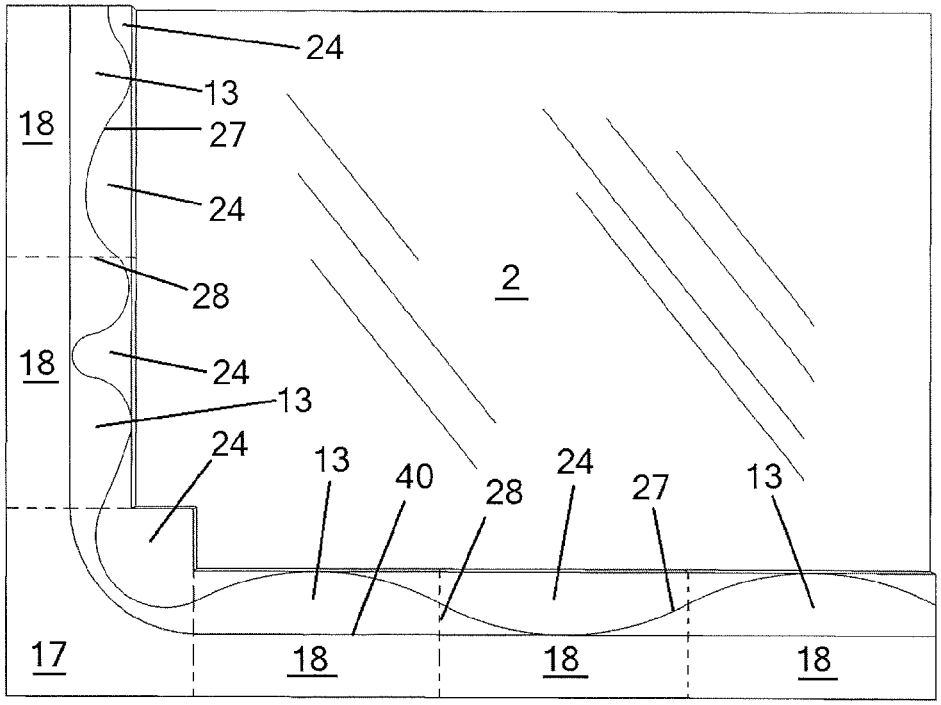
FIG. 13A is a bottom plan view of the corner and straight module components of FIGS. 7-10, showing placement on a ceiling and design intentions.
Figure 13B:
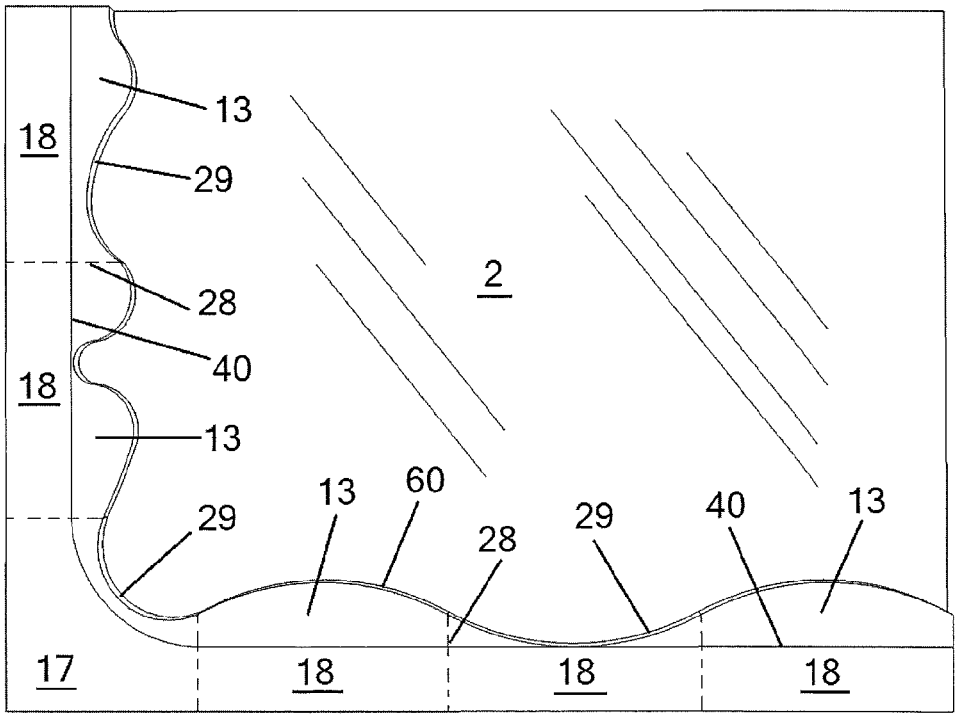
FIG. 13B is a bottom plan view similar to FIG. 13A, exhibiting design execution with removed material revealing the new designed surface of components.

FIGS. 13 and 13A are bottom plan views of a custom cut ceiling perimeter soffit arrangement in two stages, using a corner designer module 17 and several straight designer modules 18. In assembly execution, the corner designer module 17 and several straight designer modules 18 are positioned, using double sided tape, on the perimeter of existing ceiling 2 with the decorative major surface 4 facing down. Any sizing issues related to wall dimensions are resolved by trimming a straight designer module 18 perpendicular to its length. Any alignment problems are resolved by adjusting trim edges 12. The desired cut line 27 is then drawn or otherwise marked on the shapeable portion 13 of the corner designer module 17 and straight designer modules 18. In an exemplary embodiment, cut line 27 extends from one module to an adjacent module. The components are removed from their positions and cut. The material to be removed 24 is separated, revealing the newly designed surface 29. After modification, any exposed "core" surface should be re-coated to retain the structural integrity and fire protection of the component. Systems for lighting, media and security are then installed in the components as exhibited in FIGS. 31 and 32. The modules then glued with structural adhesive on attachment surface 11 and placed permanently in position. Finishing is then completed as desired. Because the contours of designed surface 29 may be determined for the particular room in which the modules are installed, even a room with irregular-sized dimensions can be fitted with a ceiling soffit with a symmetrical finished decorative edge.

Figure 14A:
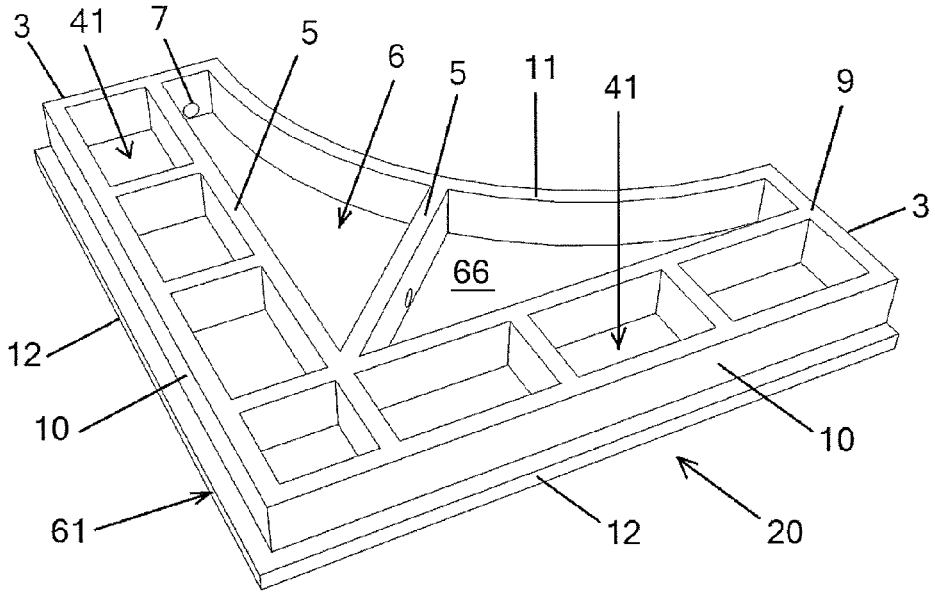
FIG. 14A is a top perspective view of an exemplary corner recessed curtain module component of an exemplary sculpted room system.
Figure 15:
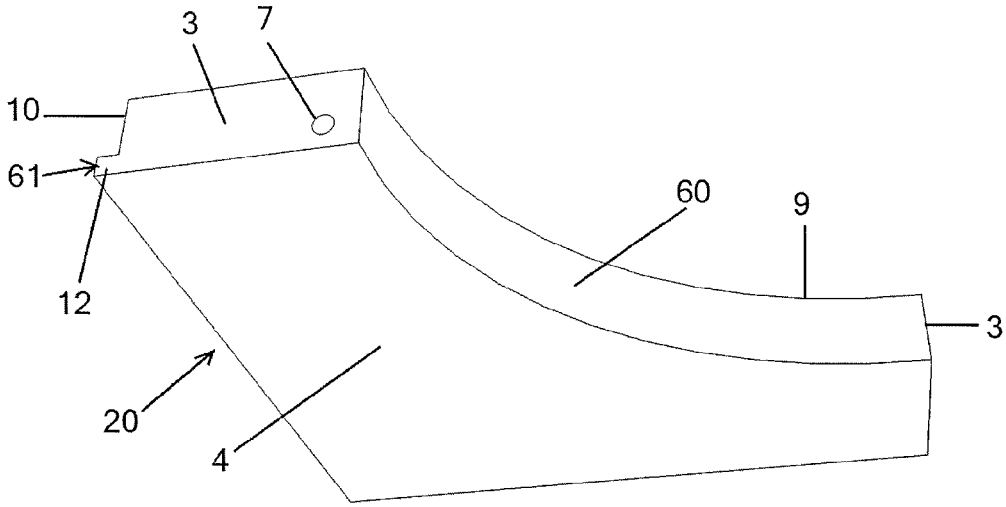
FIG. 15 is a bottom perspective view of the corner recessed curtain module of FIG. 14A.

FIGS. 14A and 15 show perspective top and bottom views, respectively, of a corner recessed curtain module 20. Corner recessed curtain module 20 includes panel 61 having decorative major surface 4 opposite interior surface 66. Structural web elements 5 extend from interior surface 61, thereby defining accessory cavities 6 on interior surface 66. Accessory cavities 6 are at least partially bordered by structural web element 5. An attachment surface 11 (in this case, the attachment surface 11 is on ceiling facing surface 9) of the structural web element 5 is configured to abut an existing wall 1 or an existing ceiling 2 (see FIGS. 18, 19) or the attachment surface 11 of another module (see FIG. 37). At least two modules are configured for adjacent attachment to the mounting surface so that their decorative major surfaces 4 are co-extensive at a joint 28 between the two modules (see FIGS. 18, 19). In an exemplary embodiment, this is accomplished by manufacturing the modules with a shared depth dimension.

Figure 18:
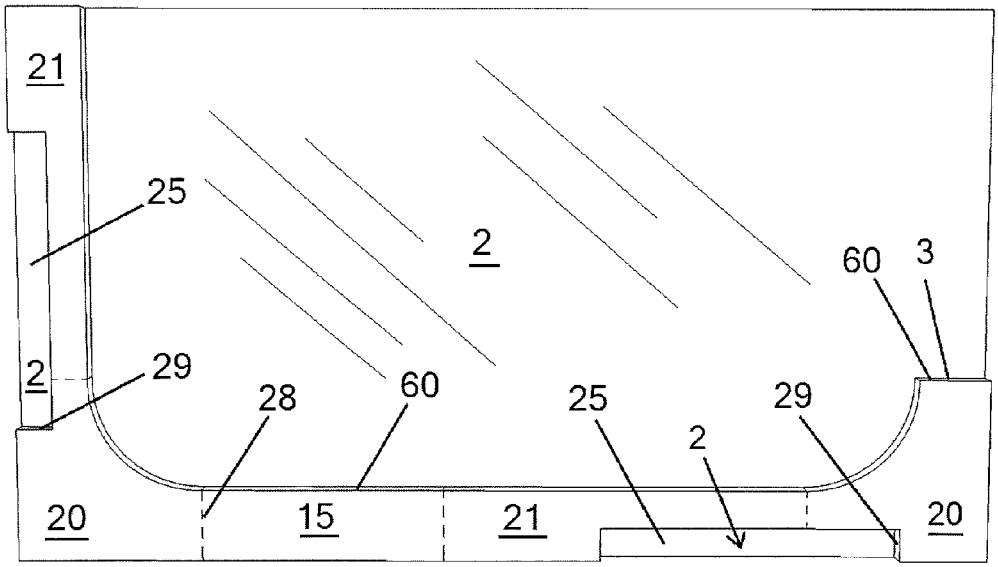
FIG. 18 is a bottom plan view of the corner and straight recessed curtain module components of FIGS. 14A-17, showing placement on the ceiling and exhibiting removed material.
Figure 19:
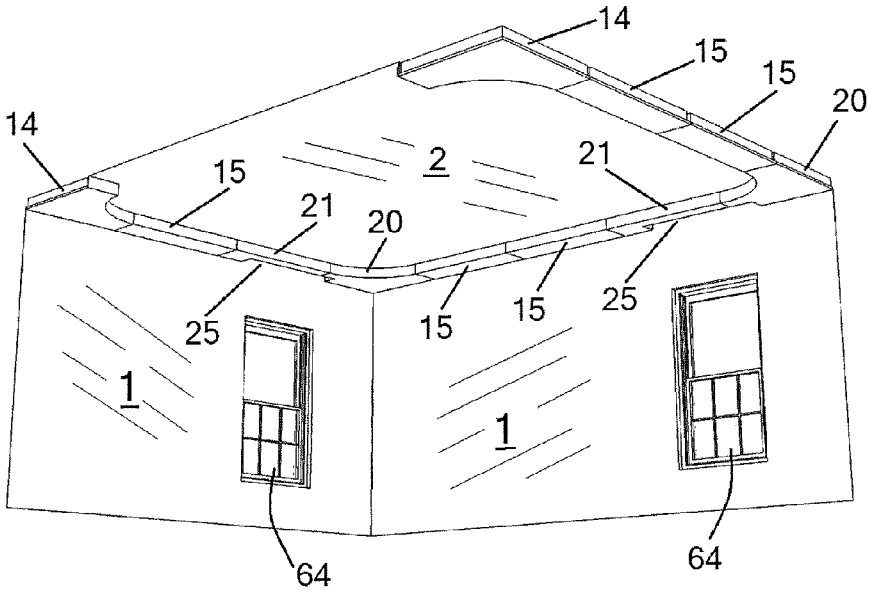
FIG. 19 is a room perspective view of an arrangement similar to that shown in FIG. 18, showing exemplary placement of the modified corner and straight recessed curtain module components of FIGS. 14A-17 over room windows, as well as the use of other components of FIGS. 1-5 of an exemplary sculpted room system.

Structural web elements 5 form crossings, equally spaced in an exemplary embodiment, of corner recessed curtain module 20. The perimeter of corner recessed curtain module 20 is formed by five surfaces: two wall facing surfaces 10, joining each other at a right angle; one decorative edge surface 60; and two joining surfaces 3, which are perpendicular to each other. In use, a wall facing surface 10 can also be a joining surface if corner recessed curtain module 20 abuts another module. An extension of panel 61 beyond a structural web element 5 forms a trim edge 12, which runs along the wall facing surface 10. Trim edge 12 can be trimmed for alignment of the modules or to accommodate irregular original construction of the room, for example. Attachment of the module to an existing ceiling in an exemplary embodiment is accomplished with structural adhesive applied to the attachment surface 11. Examples of further variable placement capabilities of corner recessed curtain module 20 are illustrated in FIGS. 18 and 19. Standard, though non-limiting, dimensions of corner designer module 17 are as follows: a length of each joining surface 3, including trim edge 12, is about 12 inches; a length of wall facing surface 10, including trim edge 12, is about 36 inches; curved decorative surface 60 is an arc for a circle having a 24 inch radius; the depth, a perpendicular distance between decorative major surface 4 and the attachment surface 11, is about four inches; and the thickness of panel 61 is about one inch.

Figure 14B:
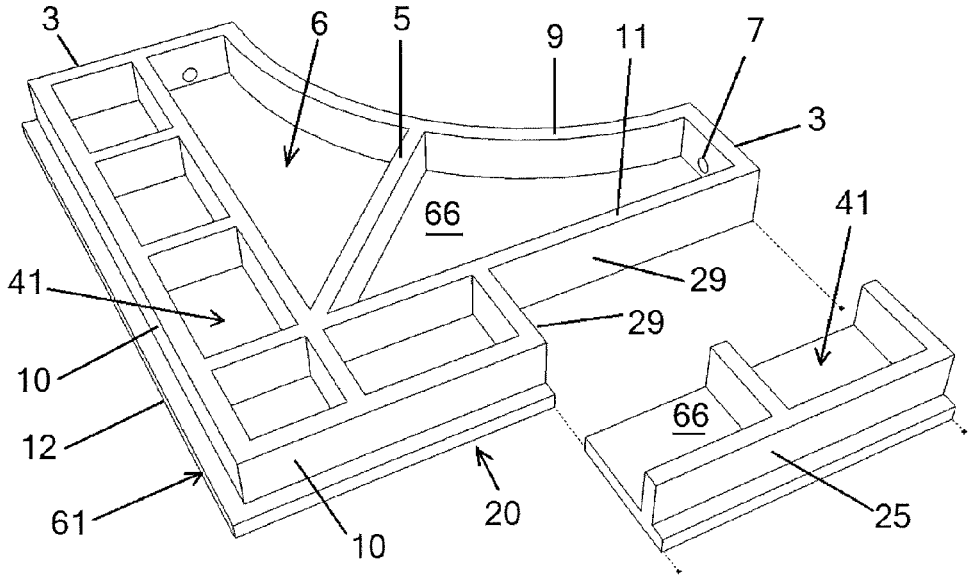
FIG. 14B is a top perspective view of the corner recessed curtain module component of FIG. 14A, exhibiting removed material for design execution.

Compared to corner module 14 of FIG. 1, a different arrangement of structural web elements 5 is used in corner recessed curtain module 20. In the illustrated embodiment, structural web elements 5 are positioned parallel to each wall facing surface 10. Further, several structural web elements 5 are positioned perpendicular to each wall facing surface 10. Moreover, a radial center structural web elements is provided. As shown in FIG. 14B, removal of material between and alongside some of the structural web elements, defined as one or more cut out cavities 41, creates a partial or whole finished opening bound by designed surfaces 29. Removed material 25 is separated from the remainder of corner recessed curtain module 20 to reveal newly exposed designed surface 29. Cutting alongside and around the structural web elements 5 as shown will leave a finished newly designed surface 29. After modification, any exposed "core" surface can be re-coated to retain the structural integrity and fire protection of the component.

Figure 16A:
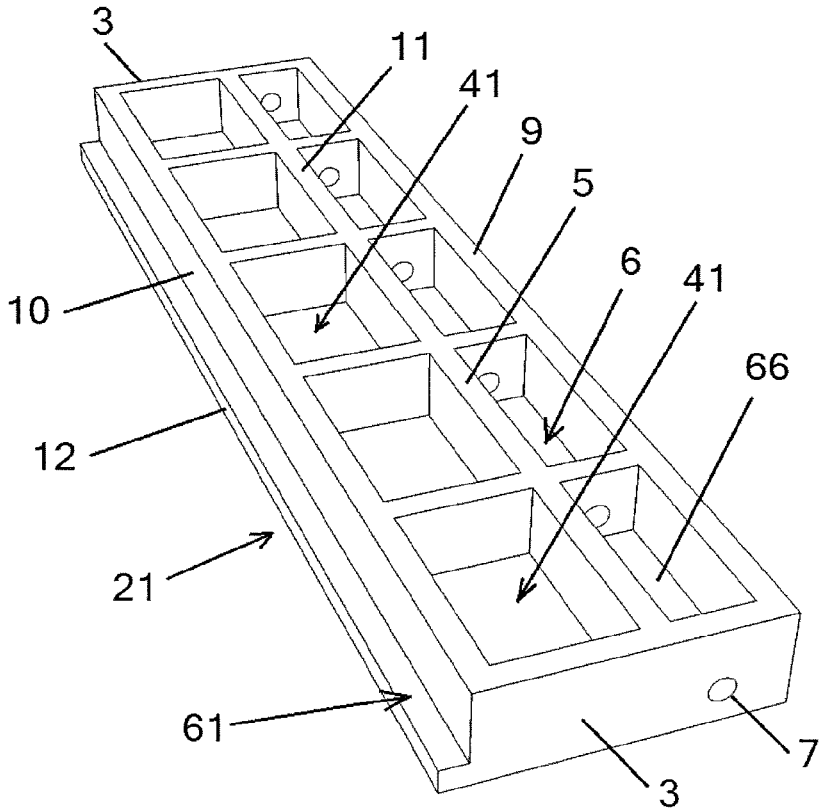
FIG. 16A is a top perspective view of an exemplary straight recessed curtain module component of an exemplary sculpted room system.
Figure 17:
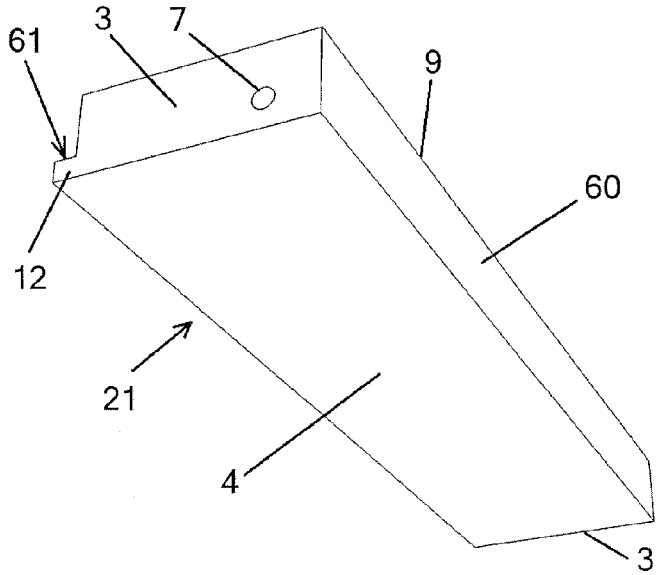
FIG. 17 is a bottom perspective view of a straight recessed curtain module component of FIG. 16A.

FIGS. 16A and 17 show perspective top and bottom views, respectively, of a straight recessed curtain module 21. Straight recessed curtain module 21 includes panel 61 having decorative major surface 4 opposite interior surface 66. Structural web elements 5 extend from interior surface 61, thereby defining accessory cavities 6 on interior surface 66. Accessory cavities 6 are at least partially bordered by structural web element 5. An attachment surface 11 (in this case, the attachment surface 11 is on ceiling facing surface 9) of the structural web element 5 is configured to abut an existing wall 1 or an existing ceiling 2 (see FIGS. 18, 19) or the attachment surface 11 of another module (see FIG. 37). At least two modules are configured for adjacent attachment to the mounting surface so that their decorative major surfaces 4 are co-extensive at a joint 28 between the two modules (see FIGS. 18, 19). In an exemplary embodiment, this is accomplished by manufacturing the modules with a shared depth dimension.

Structural web elements 5 form crossings, equally spaced in an exemplary embodiment, of straight recessed curtain module 21. The perimeter of straight recessed curtain module 21 is formed by four surfaces: one wall facing surface 10; one decorative edge surface 60; and two joining surfaces 3, which are parallel to each other. In use, a wall facing surface 10 can also be a joining surface if straight recessed curtain module 21 abuts another module. An extension of panel 61 beyond a structural web element 5 forms a trim edge 12, which runs along the wall facing surface 10. Trim edge 12 can be trimmed for alignment of the modules or to accommodate irregular original construction of the room, for example. Attachment of the module to an existing ceiling in an exemplary embodiment is accomplished with structural adhesive applied to the attachment surface 11. Examples of further variable placement capabilities of straight recessed curtain module 21 are illustrated in FIGS. 18 and 19. Standard, though non-limiting, dimensions of straight recessed curtain module 21 are as follows: a length of each joining surface 3, including trim edge 12, is about 12 inches; a length of wall facing surface 10 is about 48 inches; a length of decorative edge surface 60 is about 48 inches; the depth, a perpendicular distance between decorative major surface 4 and the attachment surface 11, is about four inches; and the thickness of panel 61 is about one inch.

Figure 16B:
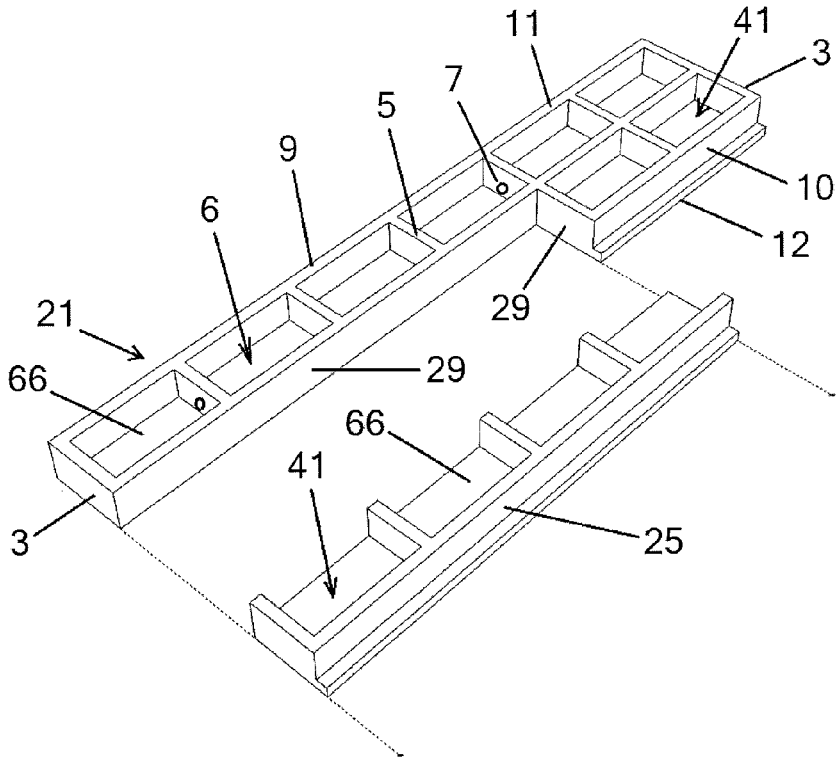
FIG. 16B is a top perspective view of a straight recessed curtain module component similar to that shown in FIG. 16A, exhibiting removed material for design execution.

Compared to straight module 15 of FIG. 3, a different arrangement of structural web elements 5 is used in straight recessed curtain module 21. In the illustrated embodiment, an additional structural web element 5 is positioned parallel to wall facing surface 10. Further, additional structural web elements 5 are positioned perpendicular to wall facing surface 10. As shown in FIG. 16B, removal of material between and alongside some of the structural web elements, defined as one or more cut out cavities 41, creates a partial or whole finished opening bound by designed surfaces 29. Removed material 25 is separated from the remainder of straight recessed curtain module 21 to reveal newly designed surface 29. Cutting around the structural web elements 5 as shown will leave a finished newly designed surface 29. After modification, any exposed "core" surface can be re-coated to retain the structural integrity and fire protection of the component.

As shown in FIGS. 18 and 19, such modification of corner recessed curtain module 20 and straight recessed curtain module 21 can be used alone or in combination to form a finished opening into which a curtain can be attached, recessed inside the soffit assembly, above the dropped ceiling level and out of sight. FIG. 18 is a bottom plan view of a partial soffit arrangement exhibiting the use modified corner recessed curtain modules 20 and straight recessed curtain modules 21. This drawing shows the modified corner recessed curtain modules 20 and straight recessed curtain modules 21 positioned on existing ceiling 2 with removed material 25 separated therefrom, creating intended cavities for recessed curtain attachment. In assembly execution, the modified corner recessed curtain modules 20 and straight recessed curtain modules 21 are first positioned, using double sided tape, on the perimeter of the existing ceiling 2 with the decorative major surface 4 facing down, as shown. Any sizing issues related to wall dimensions are resolved by trimming the straight recessed curtain modules 21, as described with respect to the similar straight module 15 of FIG. 5. Any alignment problems are resolved by adjusting trim edges 12. The modified corner recessed curtain modules 20 and straight recessed curtain modules 21 are then taken down and modified before final attachment to existing ceiling 2 with structural adhesive. Finishing is then completed as desired. This illustration also exhibits the variable placement capability of the straight module 15 as used in this layout. This assembly also displays an example where a joining surface 3 has become a decorative surface. After modification, any exposed "core" surface can be re-coated to retain the structural integrity and fire protection of the component. Moreover, any gap above a trim edge 12 and between the existing wall 1 and a wall facing surface 10 may also be filled and coated with ignition barrier material.

FIG. 19 is a room perspective view of an exemplary arrangement of modified corner recessed curtain modules 20 and straight recessed curtain modules 21 above room windows 64, along with other modules. In an exemplary installation, trimming to fit room dimensions can be done to the incorporated straight modules 15 as described with reference to FIG. 5. The unique modification and variable placement capabilities of corner modules 14, straight modules 15, and recessed curtain modules 20, 21 easily make possible an interior room accent that is very difficult to accomplish with conventional materials and techniques.

Figure 20:
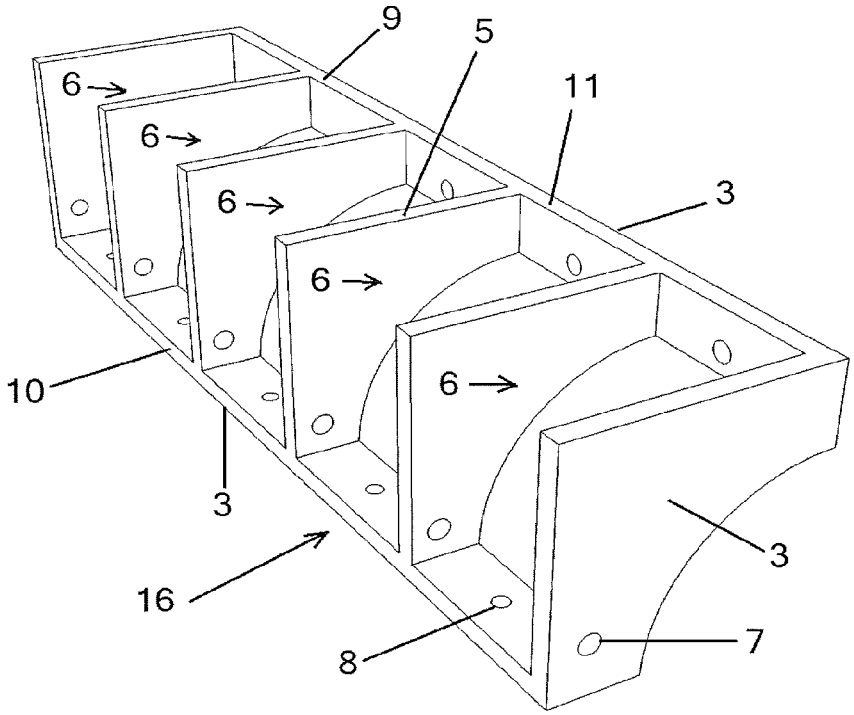
FIG. 20 is a top perspective view of an exemplary transition module component of an exemplary sculpted room system.
Figure 21:
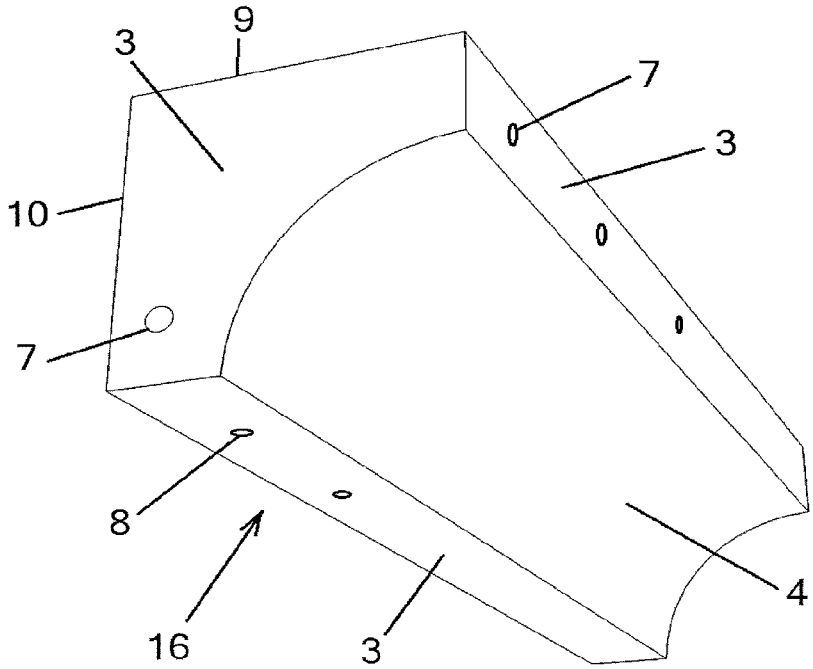
FIG. 21 is a bottom perspective view of the transition module component of FIG. 20.
Figure 22:
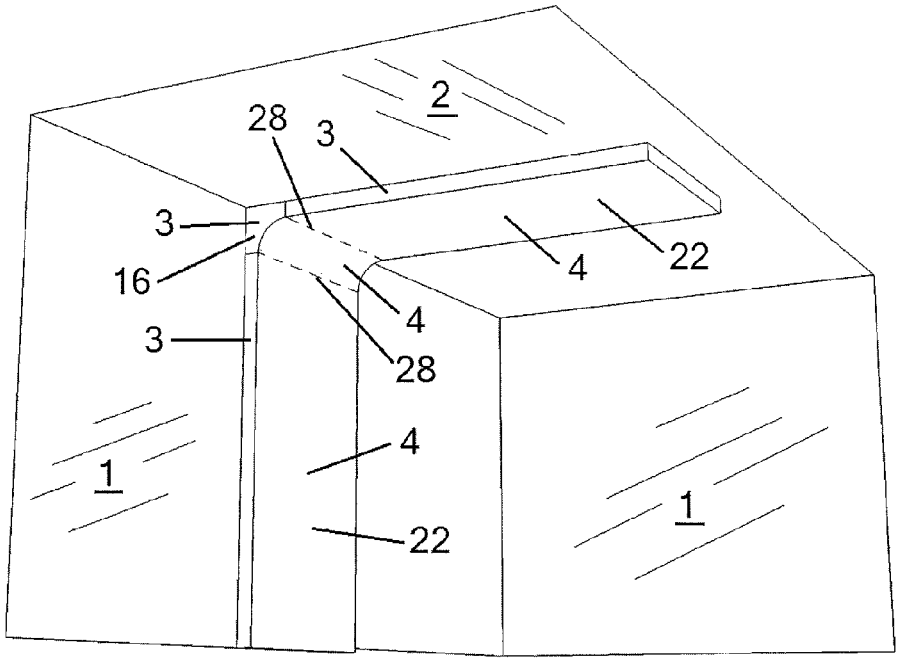
FIG. 22 is a room perspective view of application of the transition module component of FIG. 21 with two design panels, on the wall and ceiling, of an exemplary sculpted room system.

FIGS. 20 and 21 show perspective top and bottom views, respectively, of a transition module 16, which includes decorative major surface 4. Structural web elements 5 are arranged perpendicular to decorative major surface 4, forming crossings, equally spaced, of transition module 16. Accessory cavities 6 are defined between structural web elements 5. Transition module 16 has seven exterior surfaces: one ceiling facing surface 9; one wall facing surface 10; two edge joining surfaces 3; two end joining surfaces 3, which are parallel to each other; and a decorative curved major surface 4. In use, a wall facing surface 10 can also be a joining surface if transition module 16 abuts another module. Attachment of the module to an existing wall 1 and/or an existing ceiling 2 in an exemplary embodiment is accomplished with structural adhesive applied to the attachment surfaces 11. In an exemplary embodiment, transition module 16 is positioned at the corner of the existing ceiling 2 and existing wall 1, or at a corner of two existing walls 1. This placement transitions the surfaces of two design panels 22 from the wall 1 to the ceiling 2, as illustrated in FIG. 22 (or from wall-to-wall, not shown). Standard, though non-limiting, dimensions of transition module 16 are as follows: a length of each end joining surface 3 is about 12 inches and a height of each end joining surface 3 is about 12 inches; a length of wall facing surface 10 is about 48 inches; a length of each edge joining surface 3 is about 48 inches and a depth of each edge joining surface 3 is about 4 inches; the curved decorative major surface 4 is a quarter-circle arc for a circle having a radius of about eight inches; and the thickness of the curved panel having decorative major surface 4 and of the perimeter and internal structural web elements 5 is one inch.

FIG. 22 is a room perspective view showing an example of the positioning of a transition module 16 between a wall-mounted design panel 22 and a ceiling-mounted design panel 22. The installation procedures are the same as described with respect to FIGS. 6, 13 and 18. For the surfaces of the transition module 16 and design panels 22 to transition co-extensively, at the joints 28 of the transition module 16, the depth of the design panel 22 should equal the depth of the transition module 16 edge joining surface 3, as described with respect to FIGS. 20 and 21. Also, as illustrated in the example, the exposed joining surfaces 3 of the transition module 16 have now become decorative surfaces. In this installation, wire run access holes are not required on transition module 16.

Figure 23:
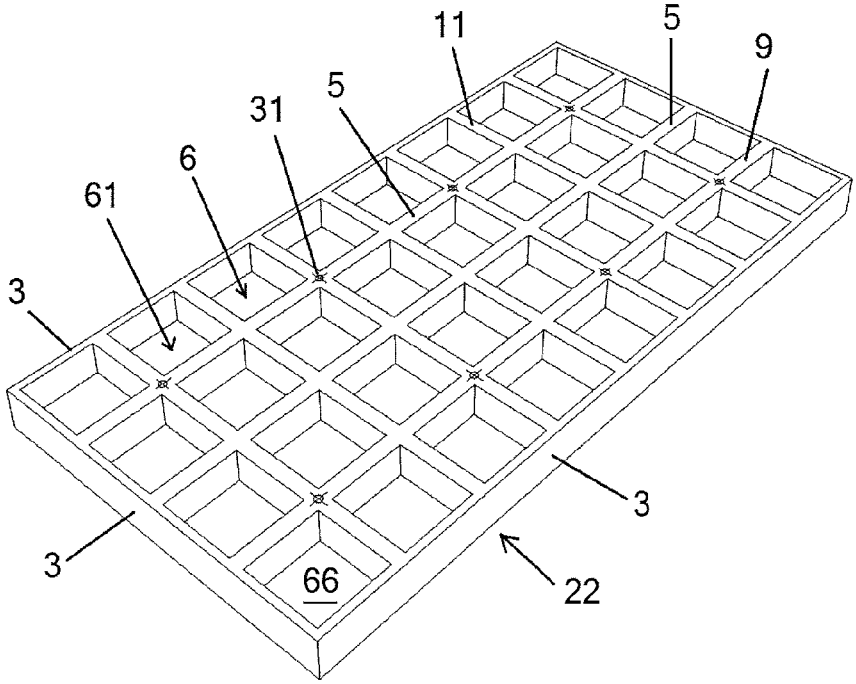
FIG. 23 is a top perspective view of the attachment surface of an exemplary design panel, exhibiting an internal webbed structure and mechanical fastener placement.

FIG. 23 shows a perspective top view of a design panel 22. Design panel 22 includes panel 61 having decorative major surface 4 (shown in FIG. 30) opposite interior surface 66. Structural web elements 5 extend from interior surface 61, thereby defining accessory cavities 6 on interior surface 66. Accessory cavities 6 are at least partially bordered by structural web element 5. An attachment surface 11 of the structural web element 5 is configured to abut an existing wall 1 or an existing ceiling 2 (see FIG. 22) or the attachment surface 11 of another module (see FIG. 37). At least two modules are configured for adjacent attachment to the mounting surface so that their decorative major surfaces 4 are co-extensive at a joint 28 between the two modules (see FIG. 27). In an exemplary embodiment, this is accomplished by manufacturing the modules with a shared depth dimension.

Structural web elements 5 form crossings, equally spaced in an exemplary embodiment, of design panel 22. The perimeter of design panel 22 is formed by four joining surfaces 3. Standard, though non-limiting, dimensions of design panel 22 are as follows: a rectangular plan shape of four feet by eight feet, with a vertical depth of four inches; a thickness of perimeter structural web elements 5 is one inch; a thickness of the internal structural web elements 5 is two inches; and a thickness of panel 61 is about one inch.

Figure 44:
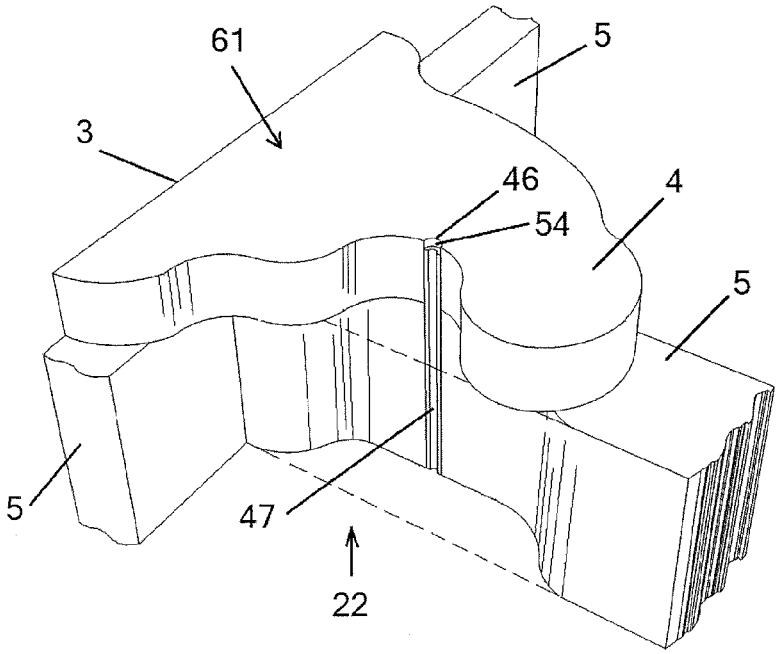
FIG. 44 is a bottom perspective view of a section of a design panel with a cut-away view of the installation and positioning of an insert tube.

In one embodiment, attachment of design panel 22 to an existing wall 1 and/or an existing ceiling 2 in an exemplary embodiment is accomplished with structural adhesive applied to the attachment surface 11. In other cases, the attachment surface 11 will be positioned to abut the mounting surface and attachment of the module to the mounting surface is accomplished with the use of mechanical or other fasteners. In one embodiment, for a monolith ceiling surface installation (for example, concrete), marked mechanical fastener locations 31 can be used with conventional fasteners such as screws, for example. For a joist ceiling installation, screws can be located anywhere through structural web elements 5. In an exemplary embodiment, the locations of structural web elements 5 are marked on the designer panel's decorative major surface 4 (shown in FIG. 30) with alignment lines 55 (shown in FIG. 45), thereby facilitating location of structural web elements 5 for alignment with ceiling joists (not shown). With the marked mechanical fastener locations 31 and/or alignment lines 55, holes can then be drilled through designer panel 22 for attachment of the designer panel 22 to existing ceiling 2 or existing wall 1 with screws or other fasteners of appropriate size and length. In an exemplary embodiment, a screw head is supported, on the decorative major surface 4 of designer panel 22, by a 'tab' style washer or with an insert tube 47 as illustrated in FIG. 44. In FIG. 44, a portion of structural web element 5 is cut away in the vicinity of fastener hole 46 to show the structure of insert tube 47, which is made of plastic in an exemplary embodiment. In an exemplary embodiment, fastener holes 46 are recessed on the decorative major surface 4 so that the head of a screw inserted therein is drawn below the decorative major surface 4 during installation. In an exemplary installation method, the recessed area is filled with a finishing material and the decorative major surface 4 is re-coated. Variable placement and modification capabilities of designer panel 22 are illustrated in FIGS. 22, 24, 25, 26, 27, 28, 29, 30, 31, 32, 34 and 38.

Figure 24:
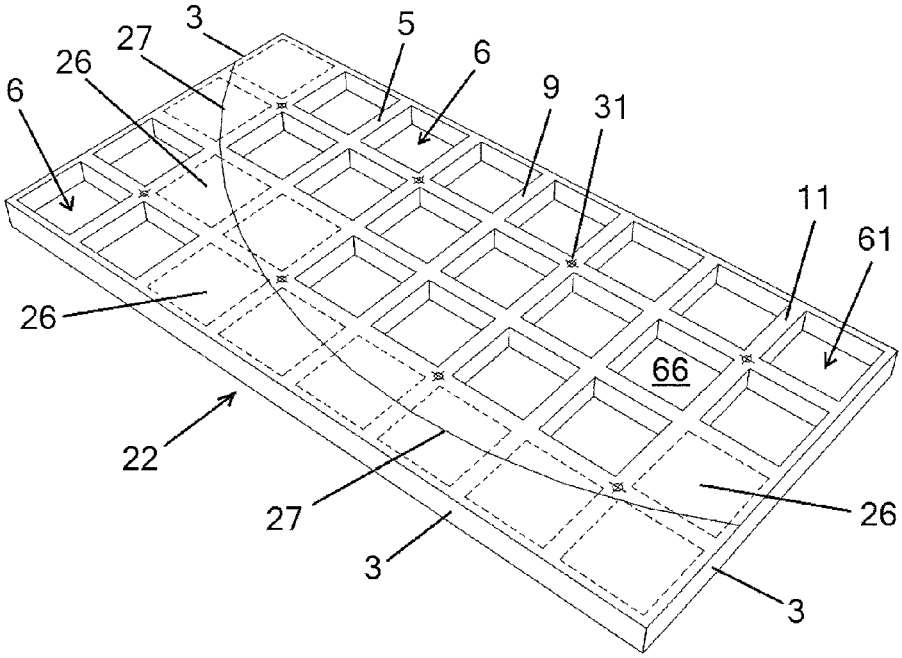
FIG. 24 is a top perspective view of the attachment surface of a design panel component, such as shown in FIG. 23, showing filled cavities along an intended design cut line to provide a finished design edge surface.
Figure 25:
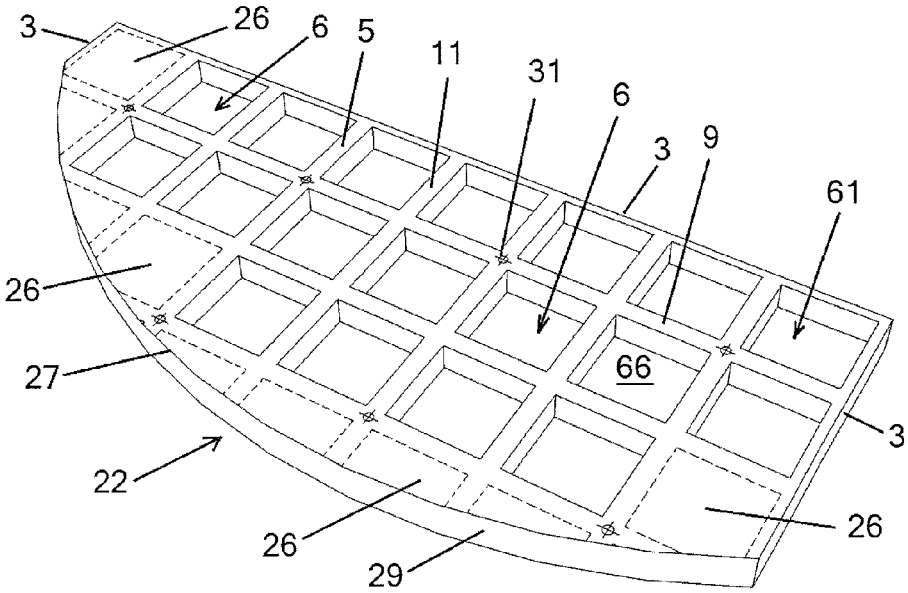
FIG. 25 is a top perspective view of the design panel of FIG. 24, showing the execution of the intended design with a finished edge.

FIGS. 24 and 25 show perspective top views of a design panel 22 exhibiting exemplary modification capabilities. In an exemplary method for shaping design panel 22, some of the cavities 6 are filled with material between interior surface 66 and attachment surface 11, such as the material making up design panel 22, to produce filled cavities 26. In an exemplary embodiment, filled cavities 26 are selected due to their position along intended design cut line 27. After the cut is executed, this process creates a new design surface 29, without the need to attach finishing material. This procedure, when used with design panel 22, offers virtually unlimited design possibilities.

Figure 26:
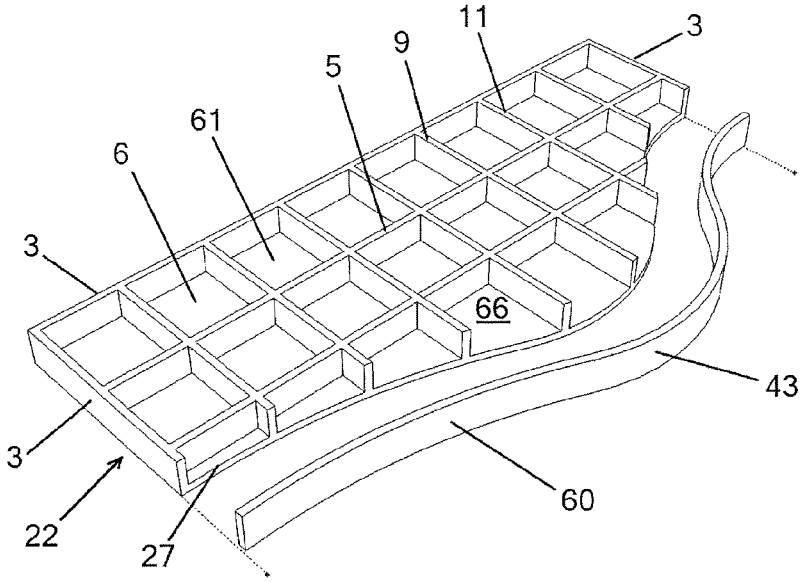
FIG. 26 is a top perspective view of the attachment surface of a design panel component, such as shown in FIG. 23, showing the use of edging material along a cut line to finish the panel.

FIG. 26 shows a perspective top view of a design panel 22, illustrating an alternative finishing process using attachment of edging material 43 (shown as finishing strip 56 in FIGS. 45, 46, and 47) to finish the design panel 22 along cut line 27. The use of edging material 43 is especially suitable in a case where a cut line 27 does not follow alongside the structural web elements 5 but instead cuts through the structural web elements 5 so that parts of cavities 6 are exposed at the cut line 27. The use of edging material 43 is also especially suitable if lighting is to be installed in the edge of a cut design panel 22, as exhibited in FIGS. 31 and 32. The attachment of edging material 43 (finishing strip 56 in FIGS. 45, 46, and 47) is accomplished with structural adhesive in an exemplary embodiment.

Figure 27:
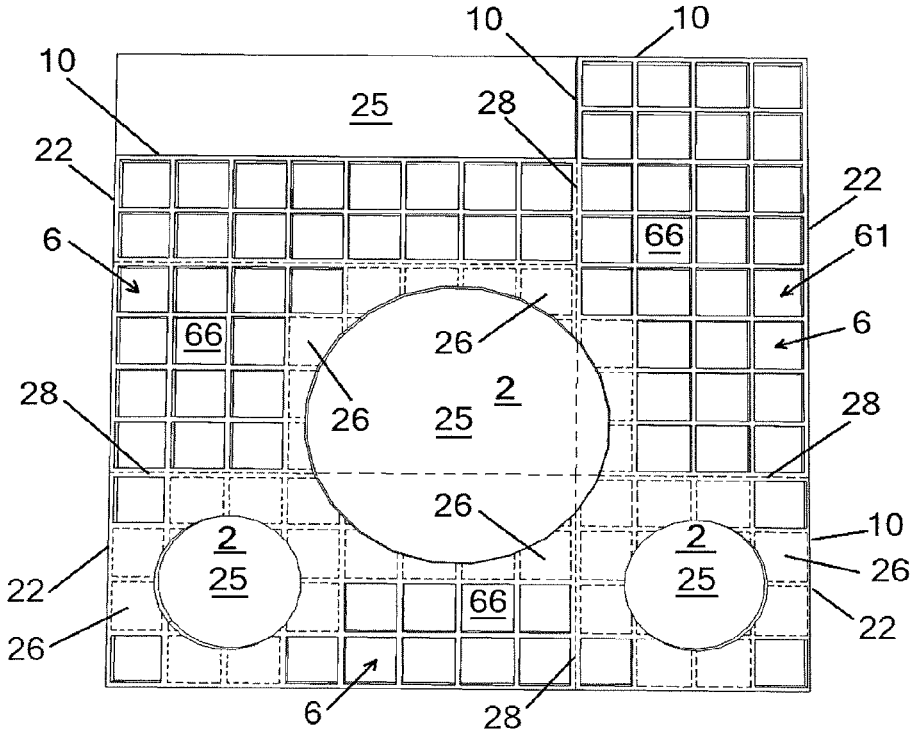
FIG. 27 is a top plan view of design panel components, such as shown in FIGS. 23-25, arranged and modified to execute a ceiling design.

FIG. 27 is a top plan view of design panels 22 modified and arranged to execute a ceiling design. The panels modified with filled cavities 26 have had the removed material 25 taken away to create a drop ceiling effect shown in FIG. 28, as described with respect to FIGS. 24 and 25. Other design panels 22 have been cut to fit the shape of the existing ceiling 2 of the room. For a continuous ceiling surface installation, marked mechanical fastener locations 31 (FIGS. 23, 24, 25) can be used. For a joist ceiling installation, screws or other fasteners can be located anywhere through the structural web elements 5. The structural web elements 5 are marked on the panel's decorative major surface 4 with web alignment lines 55, shown in FIG. 45. The marked mechanical fastener locations 31 and web alignment lines 55 facilitate the location of fastener holes 46, which can be drilled for attachment of the design panel 22 to an existing ceiling 2 or existing wall 1. In assembly execution, the joist centers (not shown) are located and marked. The design panels 22 are positioned on the existing ceiling 2 (or existing wall 1), with the decorative major surface 4 facing down (or out), using double sided tape. Fastener hole 46 locations are marked on the design panels 22. The design panels 22 are then taken down and modified for size and systems for lighting, sprinklers, media and security elements. After modification, any exposed 'core' surface can be re-coated to retain the structural integrity and fire protection of the component. The designer panels 22 are then coated with structural adhesive on the attachment surface 11 and positioned for final installation with mechanical fasteners. Finishing is then completed as desired.

Figure 28:
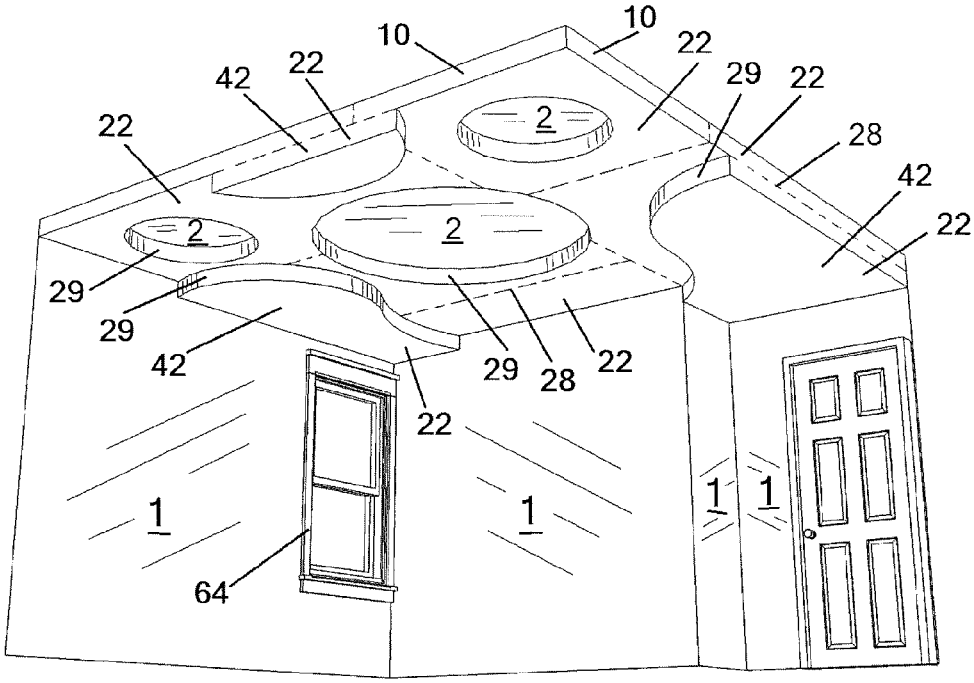
FIG. 28 is a room perspective view of the arrangement of FIG. 27, showing the new designed surfaces created by the removal of design panel material and a multi-level finish obtained by the addition of second tier design panels.

FIG. 28 is a room perspective view of the arrangement of design panels 22 of FIG. 27. This drawing exhibits the creation of a second tier drop ceiling with design panels 42 added to the arrangement. These additional design panels 42 would follow the same modification process as described in FIGS. 24, 25, 44, 46 and 47 and may use mechanical fasteners and/or adhesives to attach to the decorative major surface 4 of the base design panel 22. This drawing illustrates the variable modification and placement capabilities of design panels 22 and 42.

Figure 29:
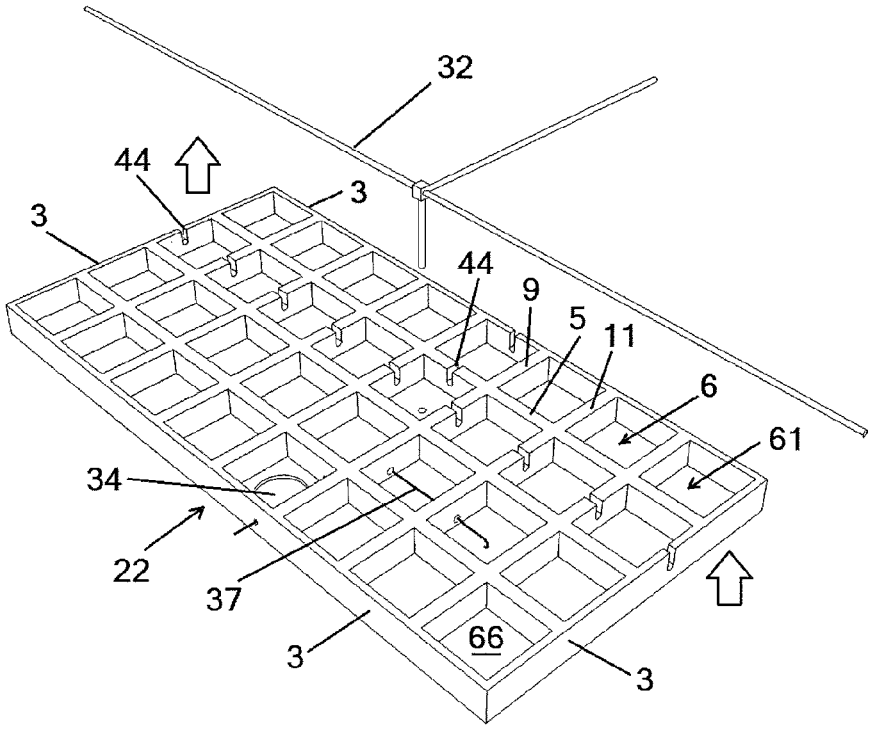
FIG. 29 is a top perspective view of the attachment surface of a design panel component accommodating fire sprinkler system components and security system wiring, with corresponding access holes.
Figure 30:
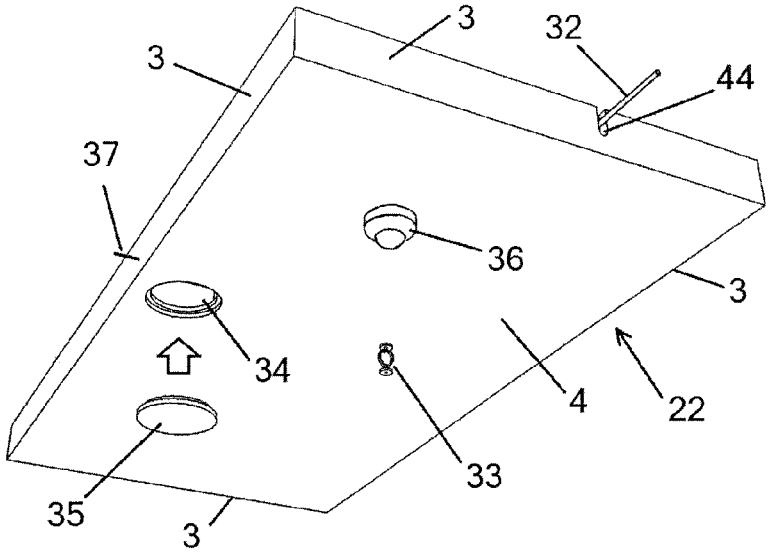
FIG. 30 is a bottom perspective view of the design panel component of FIG. 29, showing the placement of a sprinkler head and security camera, as well as the application of an access hole plug.

FIGS. 29 and 30 show perspective top and bottom views, respectively, of a design panel 22 accommodating components of fire sprinkler system 32 and electrical wiring 37 of a security system. After the design panel 22 is installed, system access holes 34 allow access to control valves and other components and allow for inspection and servicing of installed systems within a panel and between panels in a ceiling arrangement. In an exemplary method, the design panels 22 are modified for installation before final positioning on the existing ceiling 2 or existing wall 1 over previously installed fire, plumbing or wiring systems. In an exemplary embodiment, the access holes 34 through decorative major surface 4 are filled with an access hole plug 35, which is either installed with fasteners or glued in place and finished. Security cameras 36 and sprinkler heads 33 can be easily installed in the interior surfaces 66 of the accessory cavities 6.

Figure 31:
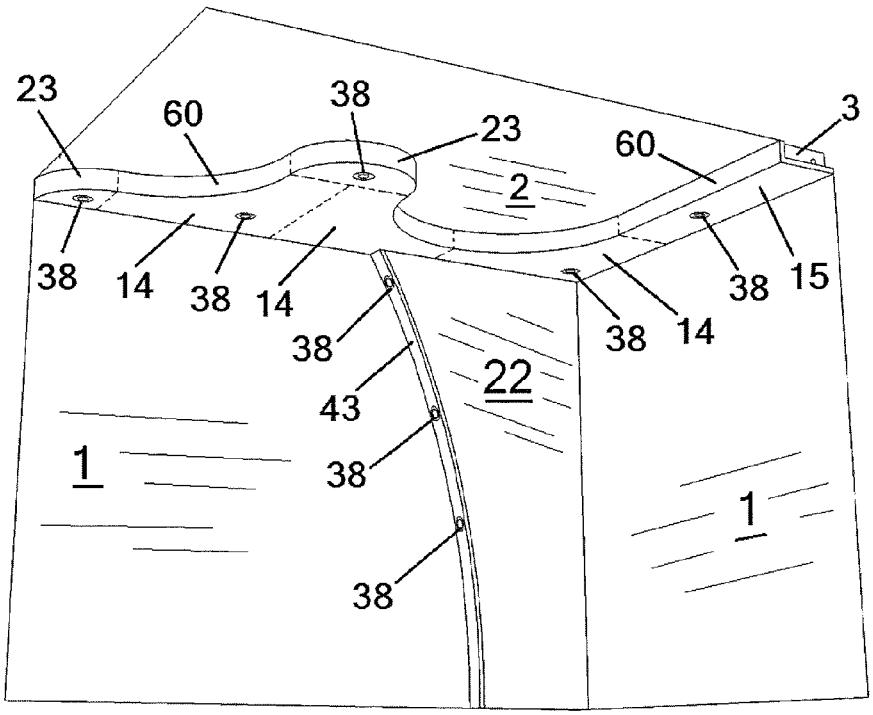
FIG. 31 is a room perspective view showing the ceiling arrangement of module components and the use of a modified design panel component as a wall application with the placement of LED lights.
Figure 32:
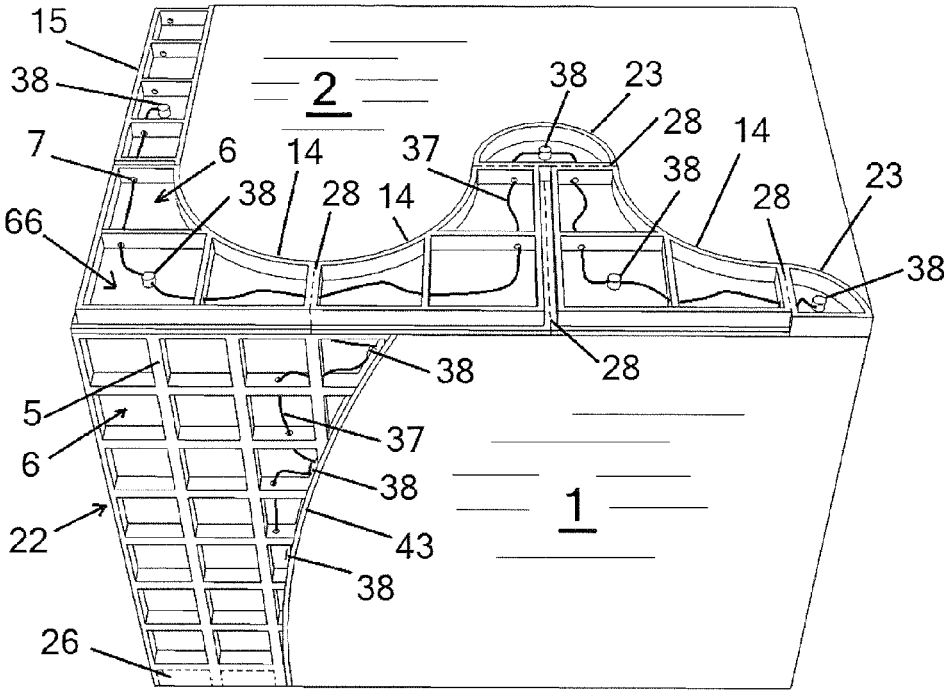
FIG. 32 is an outside room top perspective view of the arrangement of FIG. 31, showing the placement of wiring for LED light fixtures through the component structure.

FIGS. 31 and 32 are a room perspective view and a top outside room perspective view, respectively, of an installation sculpted room components of the present disclosure incorporating light fixtures 38 and their associated electrical wiring 37. In the illustrated embodiment, edging material 43 (described with reference to FIG. 26) is used to finish design panel 22 installed on existing wall 1 to accommodate light fixtures 38. The illustrations show installation of the light fixtures 38 in the interior surface 66 of the accessory cavities 6 as well as the running of electrical wiring 37 through wire run access holes 7. In an exemplary assembly execution, the corner modules 14, straight modules 15 and design elements 23 are first positioned, using double-sided tape, on the perimeter of existing ceiling 2 with decorative major surfaces 4 facing down. Any sizing issues related to wall dimensions are resolved by trimming the straight modules 15 perpendicular to their length. Any alignment problems are resolved by adjusting the trim edges 12 by trimming. The components are then taken down and modified before final attachment with structural adhesive. After modification, any exposed "core" surfaces may be re-coated to retain the structural integrity and fire protection of the component. Finishing is then completed as desired. The variable placement capabilities of a corner modules 14, straight modules 15 and design element 23 are illustrated. Design element 23 provides additional custom shapes that share the described properties of the other system components.

Figure 33:
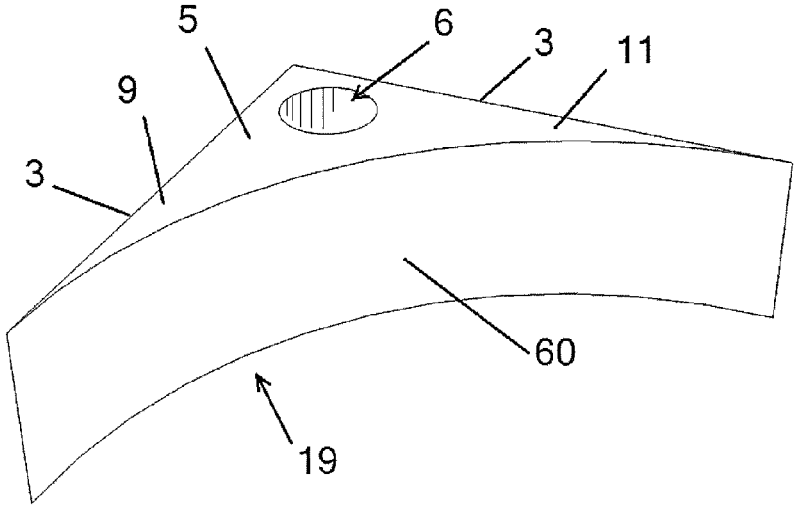
FIG. 33 is a top perspective of an exemplary ceiling-facing surface of a radius module component of an exemplary sculpted room system.

FIG. 33 shows a perspective top view of a radius module 19. Radius module 19 can be used at a corner of any combined panels or modules to radius that intersection and provide a continuously rounded ceiling or wall decorative surface. Radius module 19 comprises five surfaces: an attachment or gluing surface 11 forming the plane shape, perpendicular to which are two joining surfaces 3 at a right angle to each other; the two joining surfaces are also connected by a curved decorative edge surface 60 that completes the perimeter of the radius module 19. A decorative major surface 4 (not visible) is disposed opposite the attachment surface 11. The standard but not limited dimensions of this radius module 19 follow: a length of each joining surfaces 3 is about 12 inches; the depth, a perpendicular distance between attachment surface 11 and decorative major surface 4, is four inches; and curved decorative edge surface 60 is an arc of a circle having a radius of twelve inches.

Figure 34:
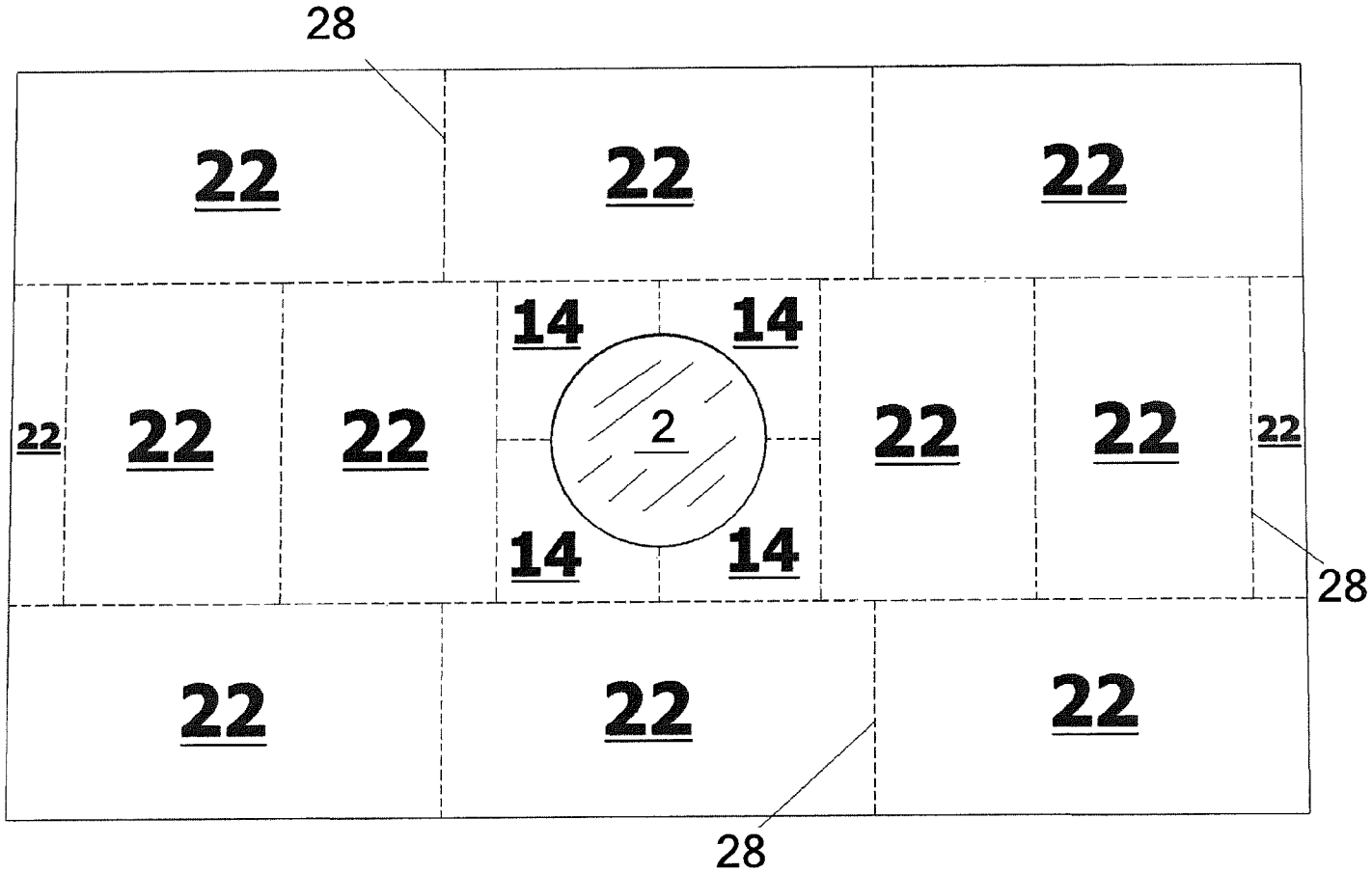
FIG. 34 is a bottom plan view of a ceiling arrangement of corner module and designer panel components, exhibiting the combination use and modification of system components.

FIG. 34 is a bottom plan view of a ceiling arrangement of cut and uncut design panels 22 and corner modules 14 exhibiting the variable placement and modification capabilities of these components. In this assembly, the corner modules' wall facing surfaces 10, as described with reference to FIGS. 1 and 2, is shown used as a joining surface 3. The installation and modification of these components is explained with reference to FIGS. 6, 24, 25, 27 and 28.

Figure 35:
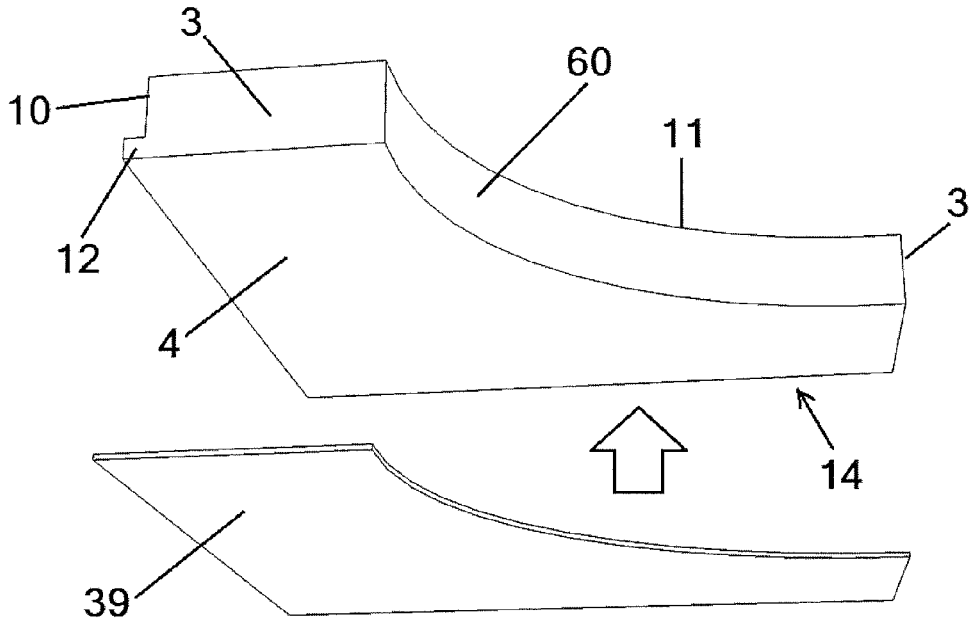
FIG. 35 is a bottom perspective view of a corner module exhibiting the application of a panel finishing sheet to its decorative surface.

FIG. 35 shows a perspective bottom view of a corner module 14 with the positioning and intended attachment of panel finishing sheet 39 to the decorative major surface 4. In an exemplary embodiment, panel finishing sheet 39 is made of Magnesium Oxide. The use of this material with any of the system's components improves the high-heat resistance of the product in suitable applications. Attachment of panel finishing sheet 39 to a module may be accomplished as a laminate in the molding process, or separately per the needs of the intended design.

Figure 36:
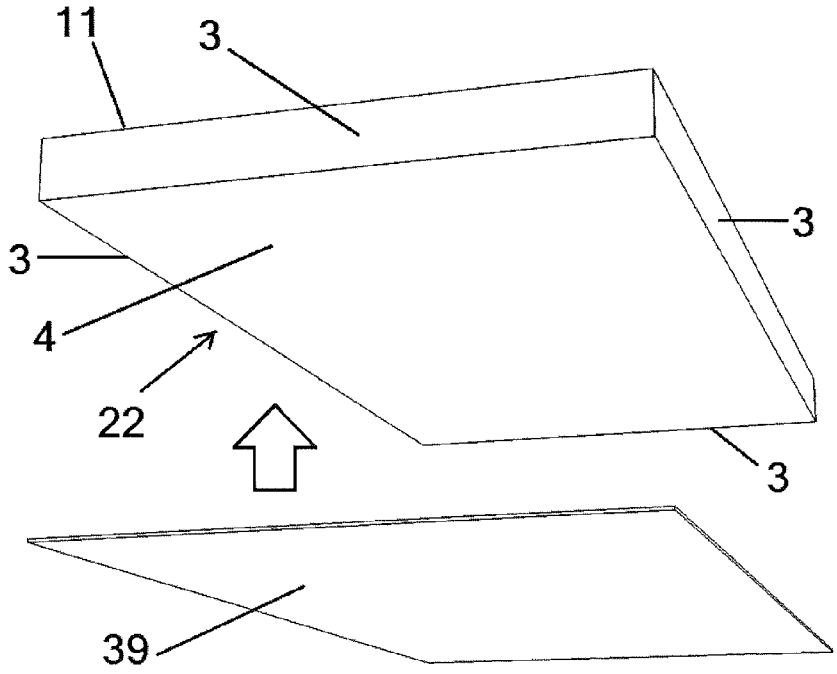
FIG. 36 is a bottom perspective view of a design panel exhibiting the application of a panel finishing sheet to its decorative surface.

FIG. 36 shows a perspective bottom view of a design panel 22 with the positioning and intended attachment of panel finishing sheet 39 to the decorative major surface 4. In an exemplary embodiment, panel finishing sheet 39 is made of Magnesium Oxide. The use of this material with any of the system's components improves the high-heat resistance of the product in suitable applications. Inclusion of panel finishing sheet 39 could be accomplished as a laminate in the molding process, or separately per the needs of the intended design.

Figure 37:
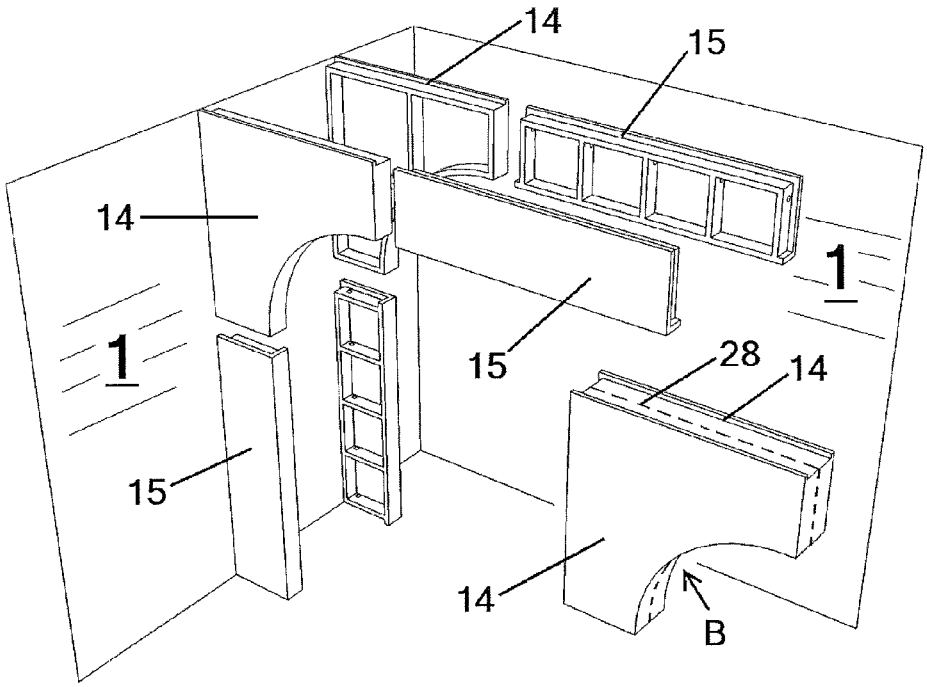
FIG. 37 is a room top perspective view of an arrangement of corner module and straight module components illustrating "same component" assembly for producing room partition elements.

FIG. 37 is a top room perspective view illustrating the intended placement and building of an arch using an assembly of corner modules 14 and straight modules 15 in assembled part B. These and the other described components can be arranged and modified as previously described and assembled together to form room elements projecting from an existing wall 1 and/or existing ceiling 2.

Figure 38:
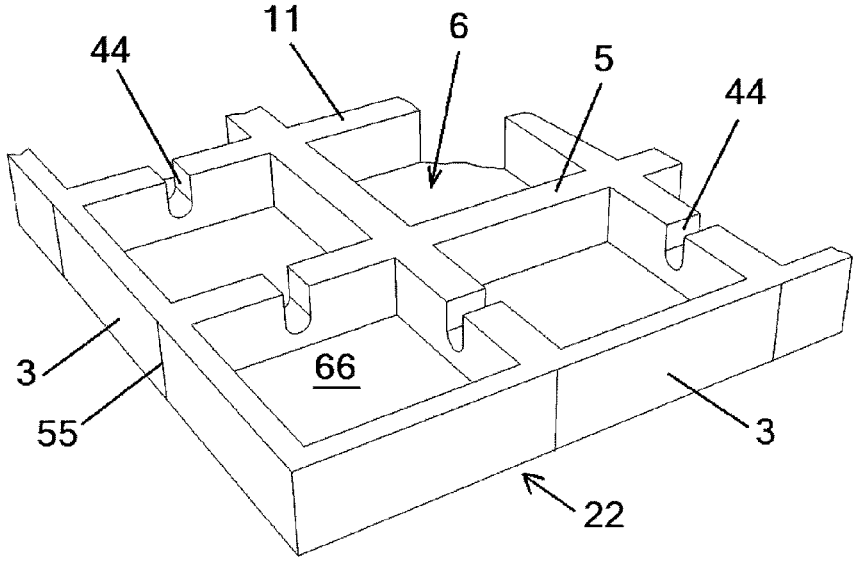
FIG. 38 is a top perspective view of a cut-out section of a design panel having cut-outs to accommodate the covering of installed systems.

FIG. 38 is a partial top perspective view of a section of a design panel 22, previously described with reference to FIGS. 23, 24, 25, 26, 27, 28, 29, 30 and 31. Apertures such as cut-outs 44 (also shown in FIG. 29) accommodate the covering of existing or new-construction fire sprinkler, plumbing and electrical systems. These modifications can be done as a matter of component manufacture or as needed per installation requirements. After modification, any exposed "core" surface should be re-coated to retain the structural integrity and fire protection of the component.

Figure 39:
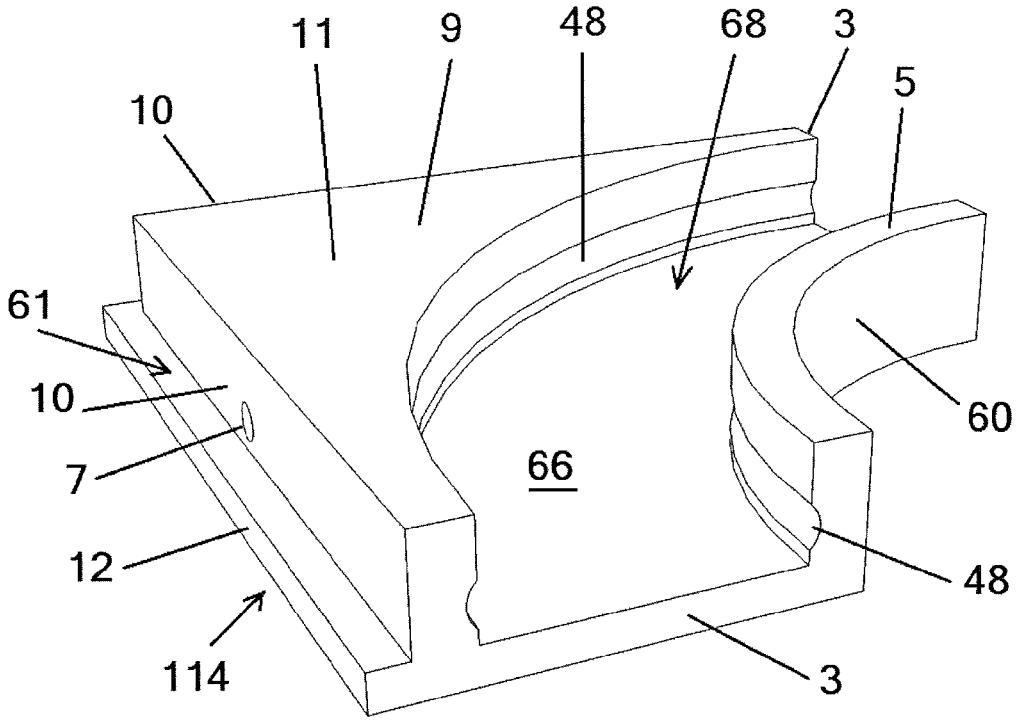
FIG. 39 is a top perspective view of an additional structural variation of a corner module component of an exemplary sculpted room system.
Figure 40:
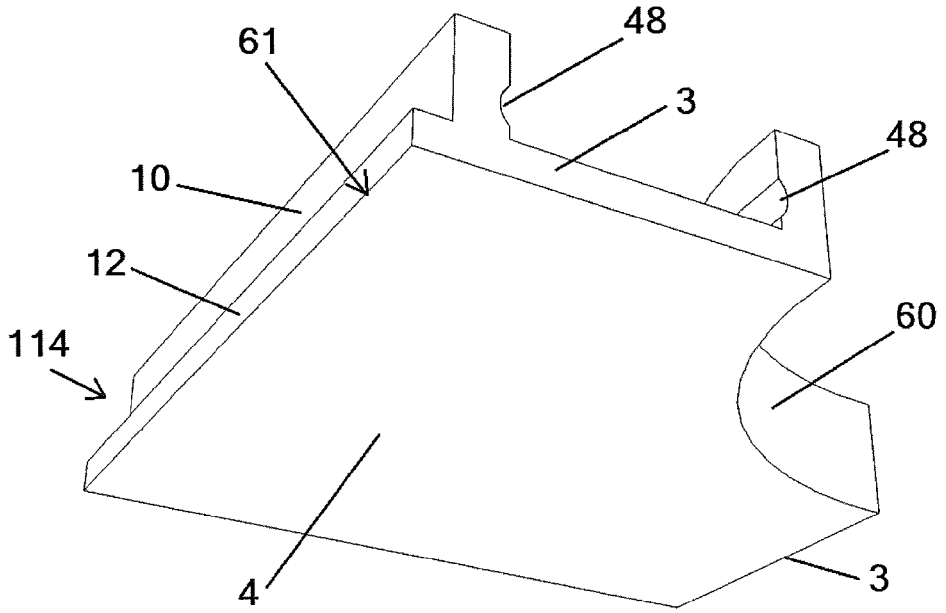
FIG. 40 is a bottom perspective view of the corner module component shown in FIG. 39.

FIGS. 39 and 40 show perspective top and bottom views, respectively, of a non-limiting additional structural variation to modified corner module 114. Having mostly the same shared structural features and functional properties as corner module 14 described with respect to FIGS. 1 and 2, the version illustrated in FIGS. 39 and 40 has an accessory cavity 68 that sweeps in an arc from one joining surface 3 to the other joining surface 3. Another feature is the integration of a clip attachment slot 48 disposed near the interior surface 66 on both sides of the accessory cavity 68. The purpose of clip attachment slot 48 is to receive and hold the engagement radius 52 of the attachment clip 49, as described with reference to FIGS. 41 and 42. This allows modified corner module 114 to be easily installed and un-installed from its designed placement in a room arrangement. The other sculpted room components of this disclosure can also be similarly modified. For example, as shown in FIG. 43, modified straight module 115 has a straight accessory cavity 68 with a straight clip attachment slot 48.

Figure 41:
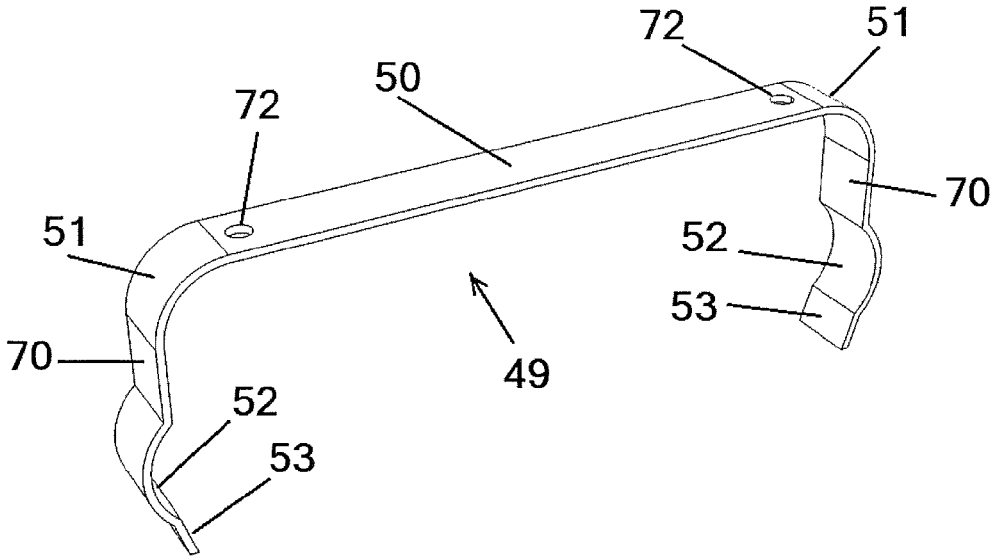
FIG. 41 is top perspective view, relative to its attachment surface, of an exemplary attachment clip of an exemplary sculpted room system.
Figure 42:
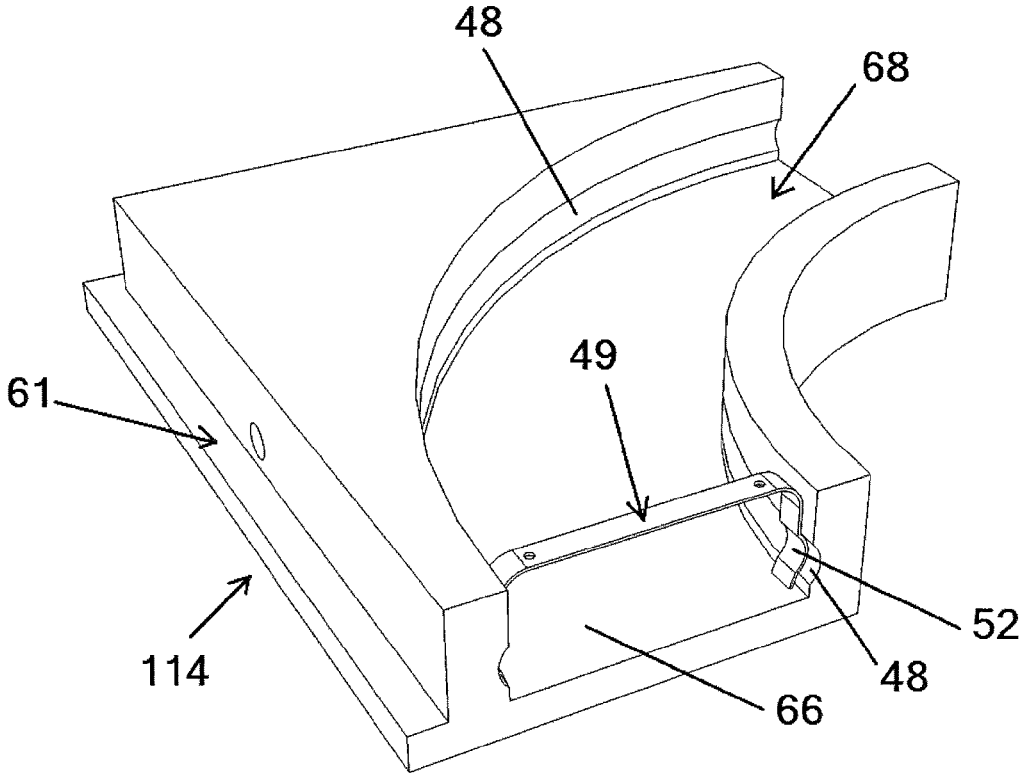
FIG. 42 is a top perspective view of the attachment clip of FIG. 41 in an installed position of a corner module of FIGS. 39 and 40.

FIGS. 41 and 42 show perspective views of an attachment clip 49 and its placement and function in modified corner module 114. The use of attachment clip 49 allows for the removal as necessary of modified corner module 114 to inspect or repair systems located under the modified corner module 114. In an exemplary embodiment, attachment clip 49 is made of spring steel and has an attachment surface 50 that is six and one half inches long and three-quarter inch wide. Attachment surface 50 runs along the back of the attachment clip 49. Each end of attachment surface 50 terminates in a three-quarter inch spring radius 51, followed by a three-quarter inch straight section 70 disposed at a right angle to attachment surface 50, leading into the one and one-sixteenth inch long by five-sixteenth inch deep engagement radius 52. During fitting of attachment clip 49 in clip attachment slot 48, engagement radius 52 pushes itself under spring tension into engagement with clip attachment Slot 48, shown in FIGS. 39 and 42. At the each end of the attachment clip 49 is a guide foot 53 set, in an exemplary embodiment, at eighteen radial degrees from the orientation of straight section 70. Guide foot 53 is used for guiding the attachment clip 49 into the accessory cavity 68. Installing the attachment clip 49 to a substrate such as an existing ceiling 2 or existing wall 1 is facilitated by using a template and marking the distance between the fastener holes 72 on the attachment surface 50 and installing fasteners.

Figure 43:
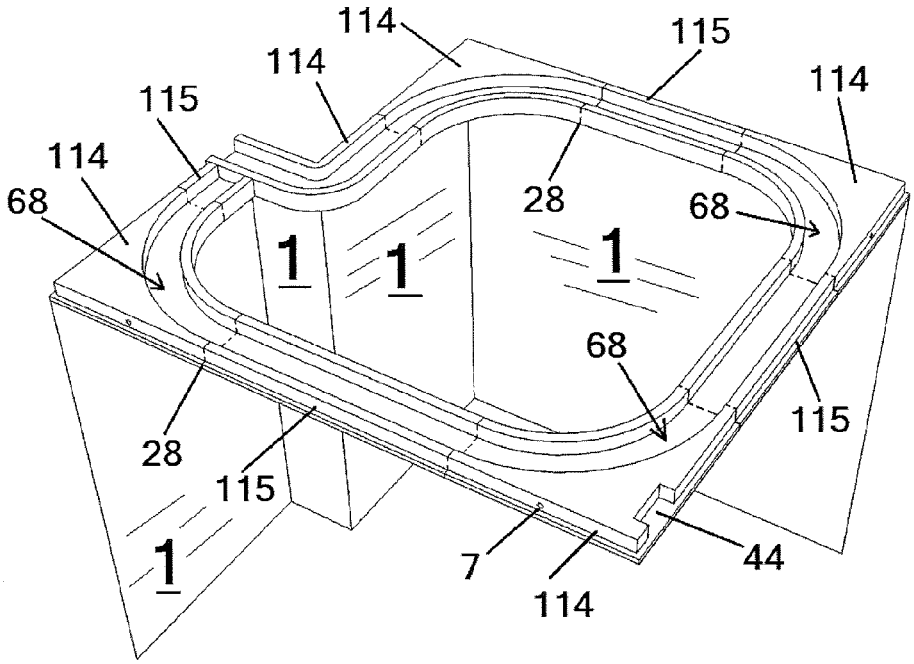
FIG. 43 is an outside room top perspective view of a ceiling arrangement of different variations of structured corner and straight modules.

FIG. 43 is a top outside room view of an arrangement of modified corner modules 114 and modified straight modules 115. The accessory cavities 68 as illustrated in these modified components 114, 115 are as described with respect to FIGS. 39 and 40. As illustrated, modified corner module 114 has a cut-out 44 to accommodate an LED transformer (not shown) mounted on the wall (not shown).

FIG. 44 is a bottom perspective cut-away view of a section of a design panel 22, showing cut-away portions of panel 61 and structural web element 5 with installation and positioning of a fastening device such as insert tube 47. Pre-drilling and installing the insert tube 47 with adhesive will prevent a fastener head (not shown) from crushing the panel 61 as the mechanical fastener (not shown) is tightened in place against the mounting substrate (existing ceiling 2 or existing wall 1). In an exemplary embodiment, a length of insert tube 47 facilitates its positioning just below the decorative major surface 4 when the insert tube 47 "bottoms out" against the mounting substrate, creating a recessed area 54 of the fastener hole 46 to accommodate the fastener head. If design panel 22 is glued in place onto the mounting surface before installing the mechanical fasteners, then there is no need to use an outside washer to hold the design panel 22 in place. The positioning of the fastener holes 46 and installation of the design panel 22 are described with reference to FIG. 27.

Figure 45:
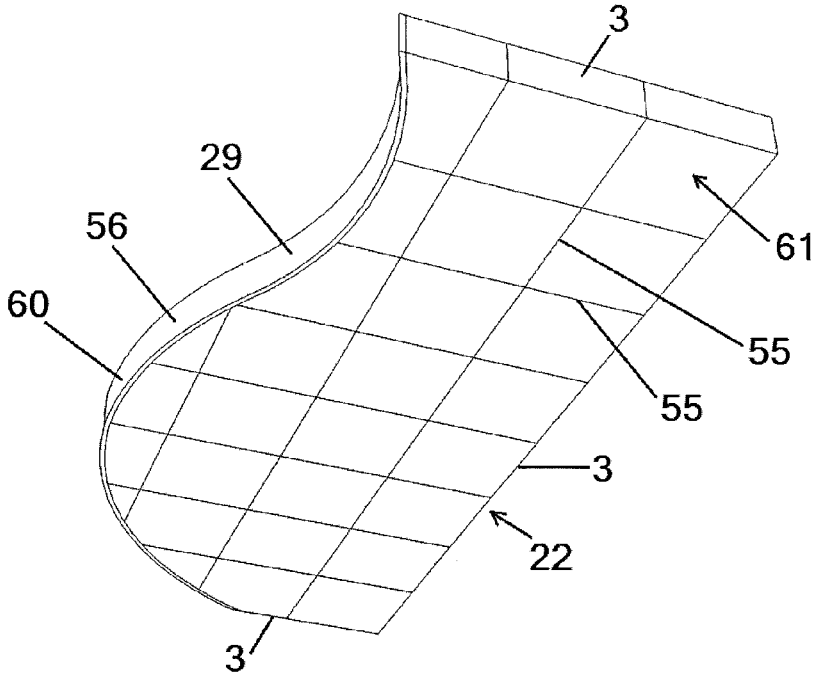
FIG. 45 is a bottom perspective view of a ceiling-installed modified design panel with an installed finishing strip.

FIG. 45 is a bottom perspective view of a ceiling-installed modified design panel 22 with an installed finishing strip 56.

This drawing also illustrates the placement of web alignment lines 55 to facilitate attachment of design panel 22 to a joist-framed existing ceiling (not shown).

Figure 46:
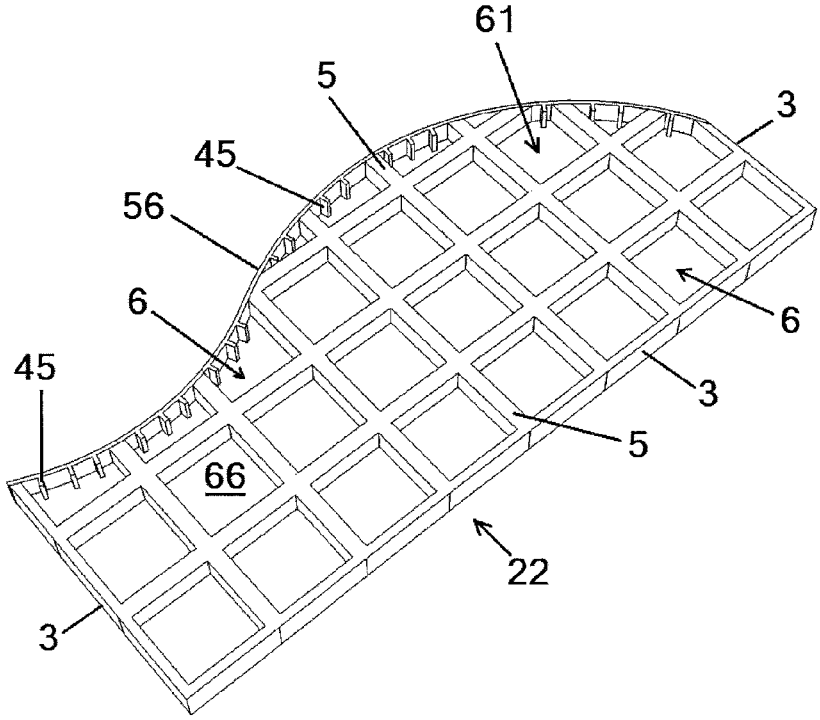
FIG. 46 is a top perspective view of the design panel of FIG. 45 showing the installation of a finishing strip and illustrating the function of its positioning tabs.

FIG. 46 is a top perspective view of the design panel 22 of FIG. 45 illustrating the installation of a finishing strip 56 and the function of its positioning tabs 45. Positioning tabs 45 project perpendicularly from finishing strip 56 at equal intervals to support the installation of the finishing strip 56 by being inserted between the interior surface 66 of the accessory cavities 6 and substrate mounting surface (i.e., existing ceiling or wall, not shown).

Figure 47:
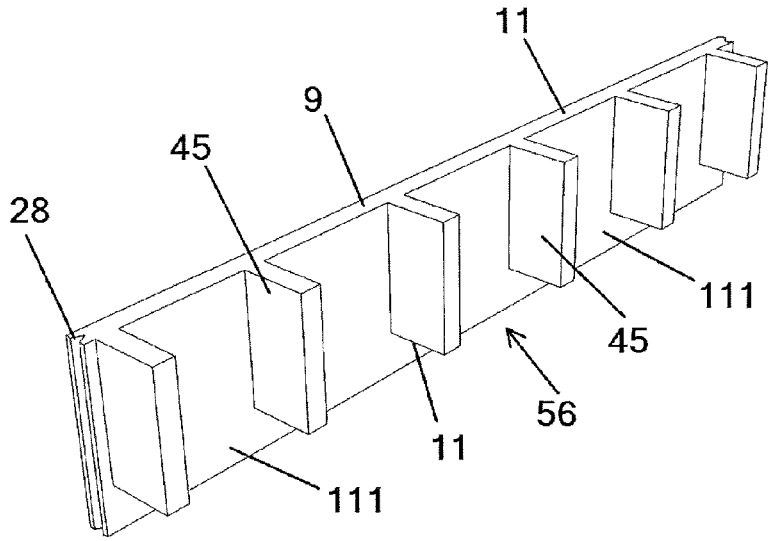
FIG. 47 is a perspective view of the attachment side of an exemplary finishing strip illustrating a positioning tab feature.

FIG. 47 is a perspective view of a section of finishing strip 56, displaying its attachment side. In an exemplary embodiment, a finishing strip component of the disclosed sculpted room system measures eight feet in length by four inches high by one half inch thick. Positioning tabs 45 are spaced at four inch intervals, flush with the ceiling facing surface 9. Positioning tabs 45 project perpendicularly from vertical attachment surface 111 by one and one-half inches, with a depth of three inches and a thickness of one-half inch. At each end of the finishing strip 56 is a centered male and female 'V' joint 28, running parallel to the depth of finishing strip 56. In other respects, finishing strip 56 may share the same material properties as the other disclosed sculpted room system components.

Figure 48:
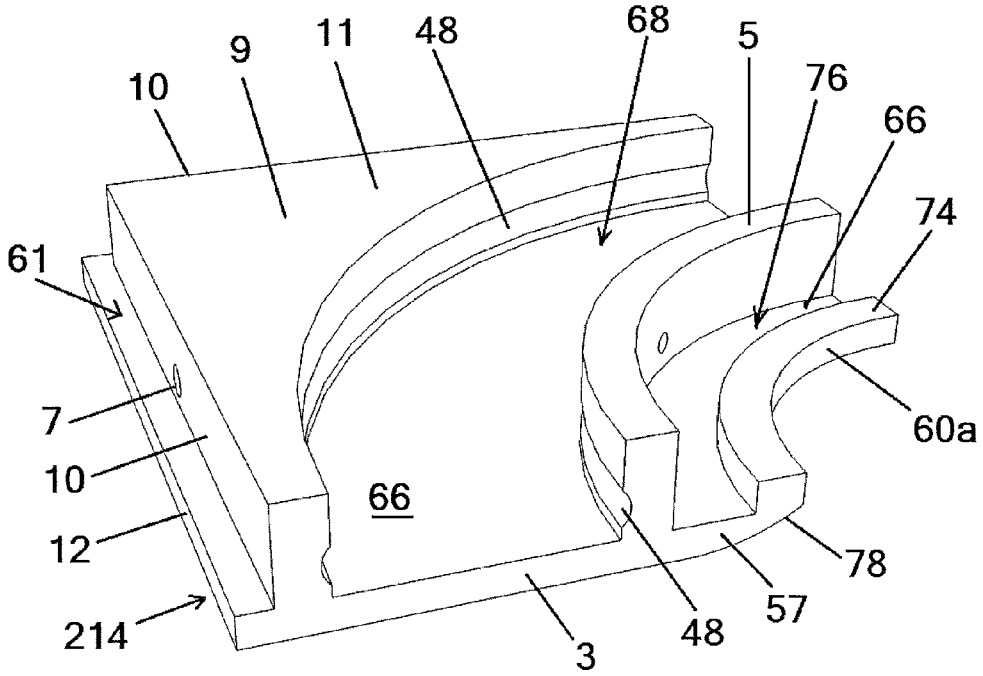
FIG. 48 is a top perspective view of an additional structural variation of a corner module component, exhibiting a component extension to accommodate the installation of indirect lighting.
Figure 49:
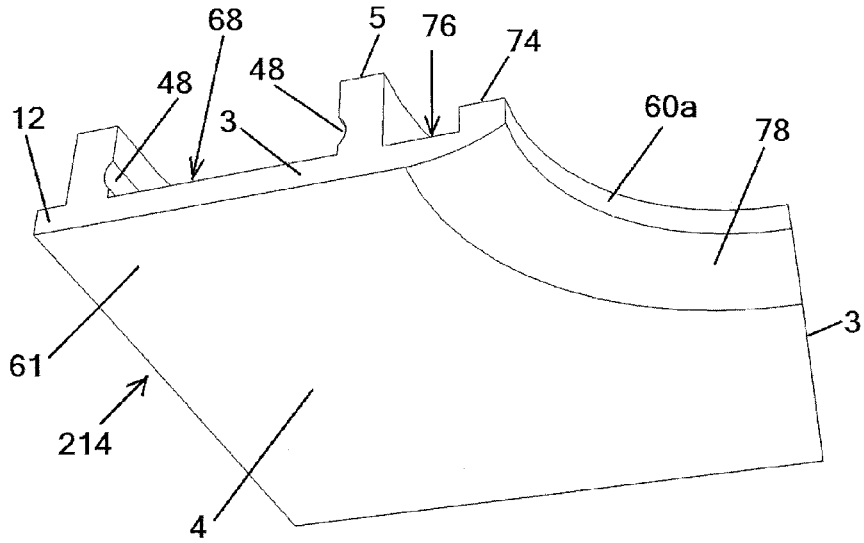
FIG. 49 is a bottom perspective view of the corner module component shown in FIG. 48.

FIGS. 48 and 49 show perspective top and bottom views, respectively, of an additional structural variation of a modified corner module 214, having mostly the same shared structural features and functional properties as modified corner module 114 described with respect to FIGS. 39 and 40. An additional feature of modified corner module 214 is a component extension 57. Along the outer edge of component extension 57, a one-inch high rim 74 projects upward from interior surface 66. The positioning of rim 74 forms an accessory cavity 76 between rim 74 and the curved decorative edge surface 60 of the corner module 114. Accessory cavity 74 is especially suitable for placement of a "hidden" light-emitting diode (LED) lighting strip (not shown) intended to project light over the rim 74 and onto the ceiling and create an indirect lighting effect. The design of modified corner module 214 also includes a dramatic shallow radius 78 that extends from the decorative major surface 4 to the outer perimeter decorative edge surface 60*a* of the component extension 57. This concept is not limited to a corner module and may be incorporated in any components of the disclosed sculpted room system.

Figure 50:
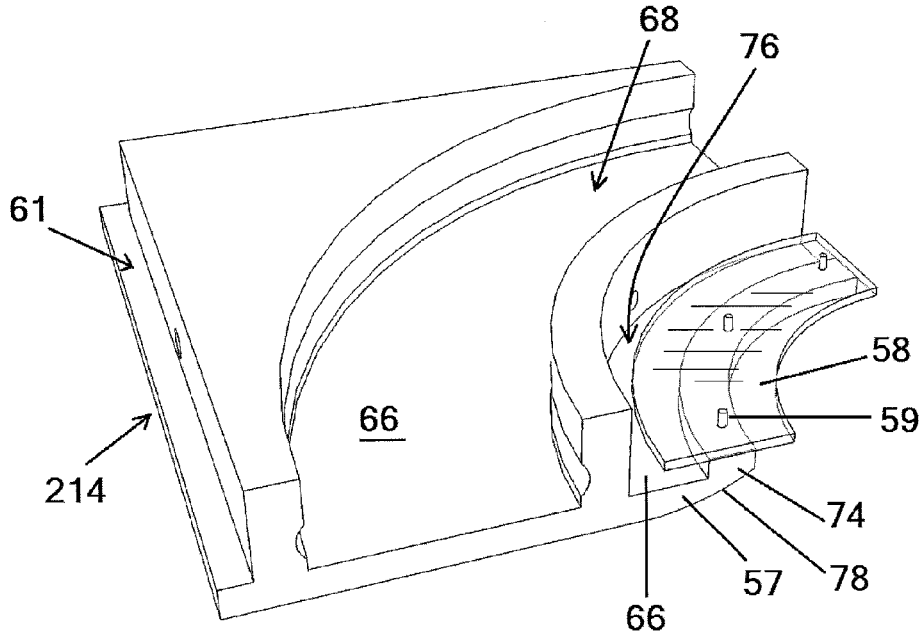
FIG. 50 is a top perspective view of the corner module shown in FIGS. 48 and 49, illustrating the installation of an illuminated plastic lens.
Figure 51:
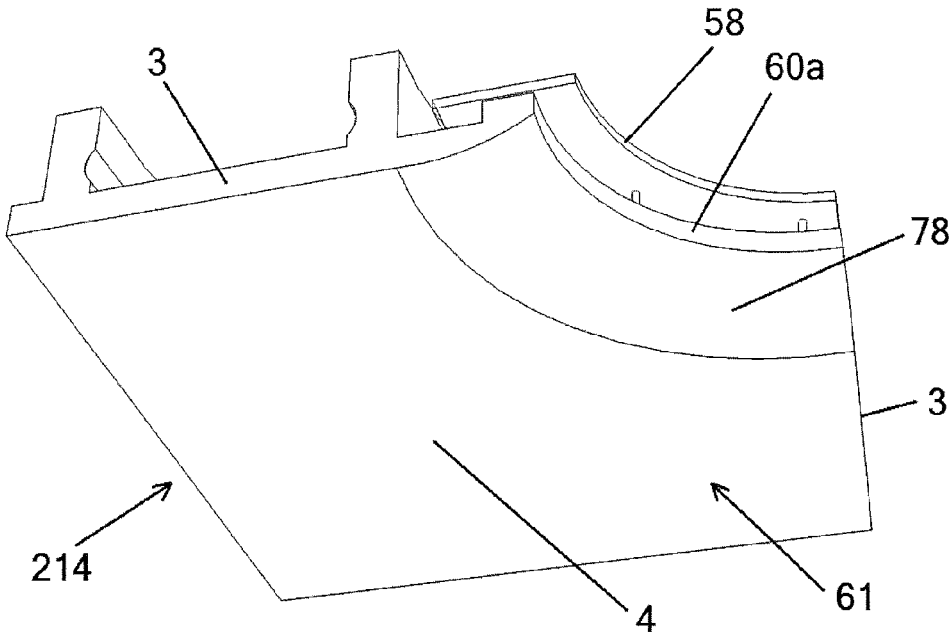
FIG. 51 is a bottom perspective view of the corner module modification shown in FIG. 50.

FIGS. 50 and 51 show perspective top and bottom views, respectively, of modified corner module 214 with the addition of a decorative functional lens 58. In an exemplary embodiment, lens 58 is made of three-eighths inch clear or tinted plastic and the shape of lens 58 follows rim 74. In an exemplary embodiment, lens 58 has a greater width than rim 74 and is attached thereto by mounting pins 59. The purpose of lens 58 is to pick up light from an LED lighting strip (not shown) located in accessory cavity 76, thereby illuminating lens 58 for a decorative effect. This concept is not limited to a corner module and may be incorporated in any components of the disclosed sculpted room system.

Figure 52:
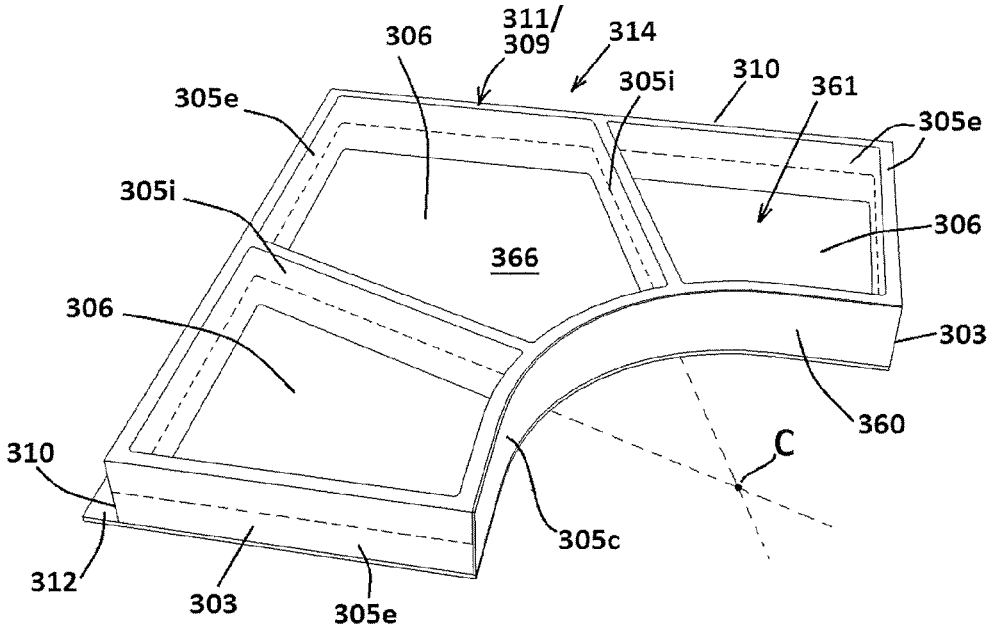
FIG. 52 is a top perspective view of another exemplary corner module component of an exemplary sculpted room system.
Figure 53:
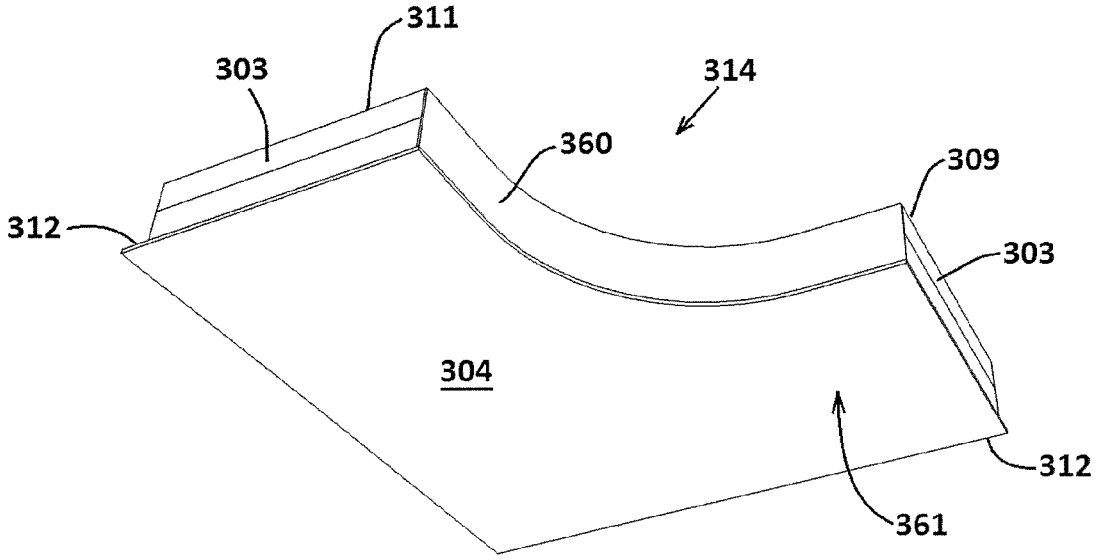
FIG. 53 is a bottom perspective view of the corner module component of FIG. 52.
Figure 54:
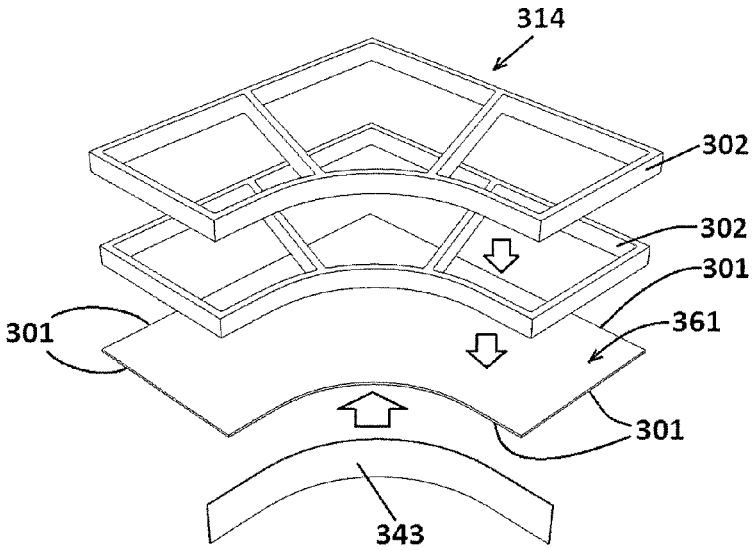
FIG. 54 is an exploded top perspective view of the corner module component of FIGS. 52-53.

FIGS. 52 and 53 are top and bottom perspective views, respectively, of another exemplary corner module 314 of an exemplary sculpted room system. Corner module 314 includes panel 361 having decorative major surface 304 opposite interior surface 366. As shown in FIG. 54, panel 361 has a plurality of edges 301 that form a closed shape. As shown in FIG. 52, structural elements 305 extend from interior surface 366 of panel 361, thereby defining accessory cavities 306 on interior surface 366. Accessory cavities 306 are at least partially bordered by structural elements 305. An attachment surface 311 (in one case, the attachment surface 311 is the ceiling facing surface 309) of the structural element 305 is located opposite interior surface 366 of panel 361. Attachment surface 311 is configured to abut a mounting surface such as an existing wall 1 or an existing ceiling 2 (see FIG. 56) or the attachment surface of another module (see, e.g., FIG. 62, where attachment surfaces of opposed module pairs are abutted). In an exemplary embodiment, the structural elements 305 form a web or grid configuration. While attachment surface 311 of structural elements 305 is illustrated as a continuous surface, it is contemplated that the attachment surface may also be in the form of a plurality of noncontiguous surfaces, in a case where structural elements 305 are not fully connected. In an exemplary embodiment, at least two modules are configured for adjacent attachment to the mounting surface so that their decorative major surfaces 4, 304 are co-extensive at a joint between the two modules (see e.g., FIG. 57). In an exemplary embodiment, this is accomplished by manufacturing the modules with a shared depth dimension of about 3.5 inches to about 6 inches.

In an exemplary embodiment, structural elements 305 are equally spaced on corner module 314. Thus, in an exemplary embodiment, some of the plurality of accessory cavities 306 are identically sized. As compared with structural web elements 5 of corner module 14, some of the structural elements 305 of corner module 314, particularly interior structural elements 305*i* (which are not positioned proximate an edge 301 of panel 361 of corner module 314), are oriented substantially radially with respect to a center point C of an approximate circle defining the radius of curvature of curved edge surface 360 (see e.g., FIG. 52).

In an exemplary embodiment, the perimeter of corner module 314 is formed by five surfaces: two wall facing surfaces 310, joined at right angles to each other; two joining surfaces 303; and a curved edge surface 360. These five surfaces are the outer surfaces of four straight exterior structural elements 305*e* and one curved exterior structural element 305*c*, each of which is positioned proximate one of the edges 301 of panel 361. In an exemplary embodiment, the four straight exterior structural elements 305*e* are in a generally rectangular orientation with respect to each other; however, the four straight exterior structural elements 305*e* do not form a complete rectangle. A fifth side of corner module 314 is completed by the curved exterior structural element 305*c*. In an exemplary embodiment, at least one exterior face of a structural element 305 is a joining surface 303 at a joint (shown in FIG. 57) between a corner module 314 and another module. In use, a wall facing surface 310 can also be a joining surface if corner module 314 abuts another module at the wall facing surface 310.

An extension of panel 361 beyond structural element 305 in at least one direction forms a trim edge 312. In the illustrated embodiment, panel 361 extends beyond structural elements 305 in two orthogonal directions, and thus trim edge 312 runs along the two wall facing surfaces 310. Trim edge 312 can be trimmed for alignment of the modules or to accommodate irregular original construction of the room, for example.

FIG. 54 is an exploded top perspective view showing the construction in one embodiment of corner module 314 of FIGS. 52-53. In an exemplary embodiment, structural elements 305 are formed from two layers 302 of foam board containing magnesium oxide and/or composites thereof. Magnesium oxide building materials create light-weight and Class-A fire-rated components. These materials may be obtained in the form of board and foamed board from Southern Cross Building Products of Delray Beach, Fla. In an exemplary embodiment, each layer 302 is routed or knife press cut from a piece of foamed magnesium oxide board. Other suitable Class-A materials include composite insulation boards containing materials such as perlite, glass carbon foam, hydrous calcium silicate and reinforced silica and lime. One suitable material is commercially available under the name Super Firetemp® L from Industrial Insulation Group, LLC of Brunswick, Ga. Especially suitable materials are relatively inexpensive, are easily machinable, will accept a glue bond, will accept finishing products, are inorganic, are recyclable, have a high degree of dimensional stability, have high flexure and compression strengths, have high fastener pull-out strength, can withstand temperatures exceeding 1200 degrees F., and are light-weight, with density in a range of about 7-18 pounds per cubic foot.

In an exemplary embodiment, each layer 302 is about 2 inches thick, resulting in assembled structural elements 305 being about 4 inches thick. However, it is contemplated that more or fewer layers 302 may be used and layers 302 of other thicknesses may be used. Moreover, the different layers 302 need not all have the same thickness. Standard, though non-limiting, dimensions of corner module 314 are as follows: a length of each joining surface 303, including trim edge 312, is about twelve inches; a length of each wall facing surface 310 is about 36 inches; and curved edge surface 360 is an arc for a circle having a 24 inch radius. In an exemplary embodiment, panel 361 is formed from a magnesium oxide and/or composite board having a thickness of about one-quarter inch. In an exemplary embodiment, edging material 343 for placement on curved edge surface 360 is formed from a magnesium oxide and/or composite board having a thickness of about one-eighth inch. In an exemplary embodiment, each structural element 305 has a width of about 2.75 inches. In an exemplary embodiment, sodium silicate adhesive is used to adhere the layers 302, panel 361 and edging material 343 together to form corner module 314. However, it is contemplated that other adhesives and attachment means and methods may be used.

Figure 55:
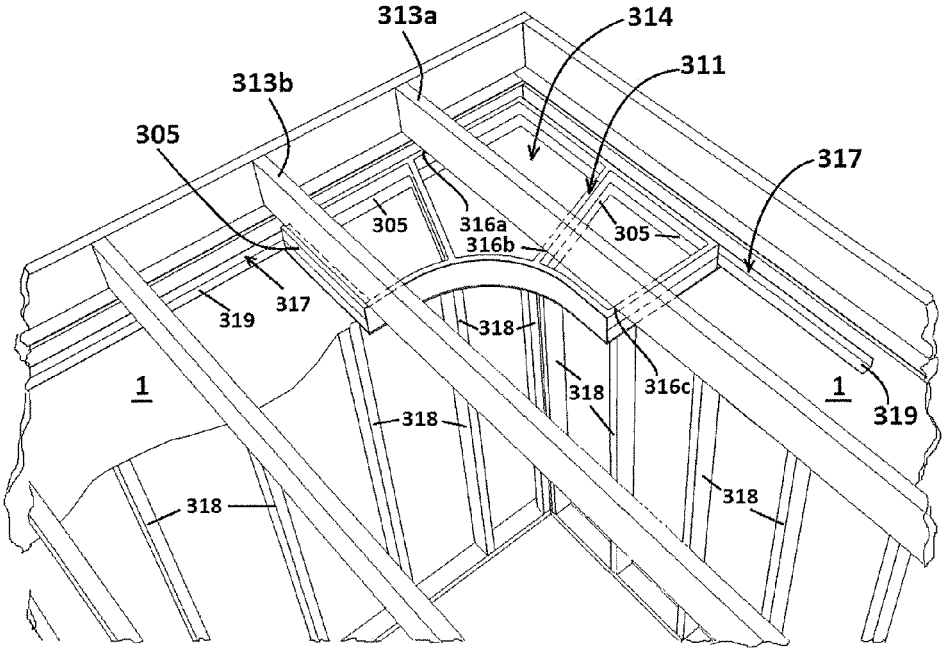
FIG. 55 is a top perspective view of the corner module component of FIGS. 52-54, installed in a ceiling application.
Figure 56:
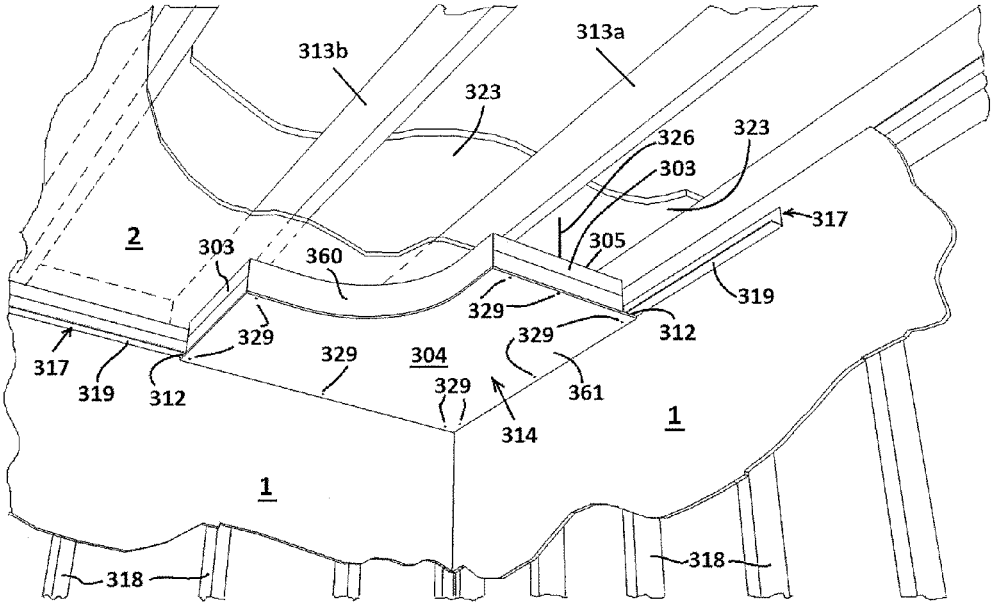
FIG. 56 is a bottom perspective view of the installation of FIG. 55.

FIGS. 55 and 56 are top and bottom perspective views, respectively, of corner module 314 installed in a ceiling application. In FIG. 55, the ceiling joists 313 are exposed for clarity, and there is no gypsum board attached to the ceiling joists 313. However, it is contemplated that in typical installations, such as in retrofitting a finished room, corner module 314 (as well as other modules) may be attached through any existing ceiling 2 and to the ceiling joists 313, as shown in FIG. 56. In the illustrated application, attachment surface 311 of corner module 314 contacts ceiling joist 313*a* such as at contact points 316*a*, 316*b*, 316*c*; further, corner module 314 contacts ceiling joist 313*b* all along the structural element 305 that is aligned with ceiling joist 313*b*. Thus, in the exemplary embodiment, corner module 314 is sized so that a structural element 305 lines up with joists of an existing ceiling, studs of an existing wall, or existing roof trusses. Because several different joist, stud, and truss spacings are relatively standard (i.e., 16 inches on center, 19.2 inches on center, 24 inches on center, etc.), different configurations of all of the disclosed modules may be provided to achieve an alignment as illustrated. Moreover, it is evident that even if a module does not line up with a joist as illustrated (i.e., where a structural element 305 substantially aligns with joist 313*b*), the structural elements 305 are configured in a web or grid arrangement to provide multiple potential contact points (and thus, possible attachment points) for a wide range of joist, stud, and truss spacings.

In an exemplary attachment method, attachment surface 311 of structural elements 305 is affixed to joists 313*a*, 313*b* or existing ceiling 2 such as by the use of structural adhesive. In some cases, such affixation is sufficient. In other applications, mechanical fasteners 329 are additionally or alternatively used to fasten module 314 to joists 313*a*, 313*b*, as explained with reference to FIG. 44, for example. In the illustrated embodiment, attachment ledger 317 is fastened through existing wall 1 (only a portion of which is shown) to wall studs 318. In that case, trim edge 312 of panel 361 may be attached to a flange 319 of attachment ledger 317, such as by mechanical fasteners 329, to further anchor corner module 314, as shown in FIG. 56.

FIG. 56 additionally shows ceiling 2, which may be formed of gypsum sheets or plaster, for example, in an exemplary embodiment. Moreover, FIG. 56 also shows board 323 on top of ceiling joists 313. In one embodiment, board 323 may be a sub-floor board of a story above ceiling 2. FIG. 56 shows further anchoring of corner module 314 using anchor 326 through panel 361, structural element 305 and board 323. Exemplary anchors 326 include a sub-floor attachment screw or a rod, cable or wire with mechanical fasteners on the ends thereof to secure the ends to panel 361 and board 323. Accordingly, corner module 14 may be securely fastened to ceiling 2 in locations where structural elements 305 do not contact ceiling joists 313. While FIGS. 55-56 show a ceiling-installed corner module 314, it is to be understood that similar methods may be used to install all of the described modules on a ceiling, wall, or on another module.

Figure 57:
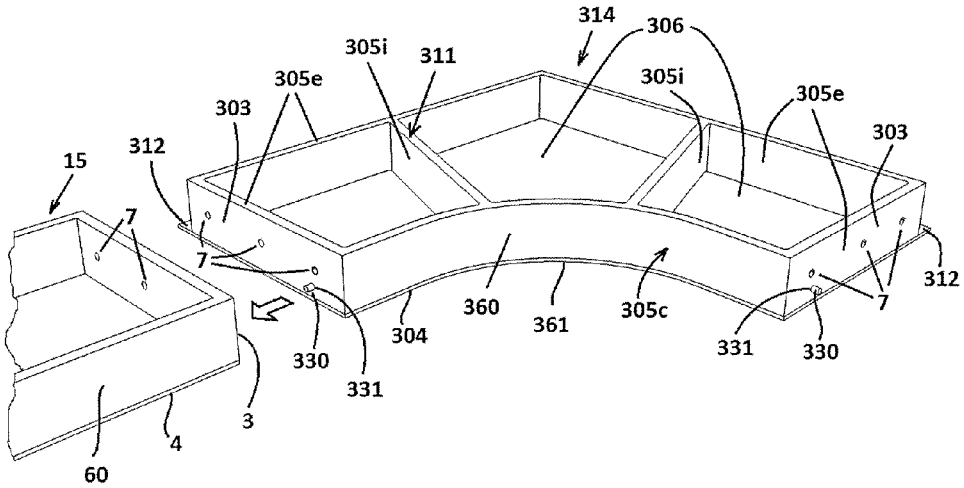
FIG. 57 is a top perspective view of the corner module component of FIG. 52 aligned with a straight module using alignment pins.

FIG. 57 is a top perspective view of the corner module 314 aligned with a straight module 15 using alignment pins 330. In an exemplary embodiment, alignment pin 330 is positioned in cooperating recesses or apertures 331 in joining surfaces 3, 303 to ensure alignment between corner module 314 and straight module 15. With proper alignment, curved surface 360 is contiguous with edge surface 60 and decorative major surface 304 is contiguous with decorative major surface 4. While a single alignment pin 330 is shown for the joint between corner module 314 and straight module 15, it is contemplated that a plurality of alignment pins 330 may be used at each joint. Any mating structure (such as including, e.g., a pin, dowel, stud or like structure) may be used for achieving such proper alignment of adjacent modules.

Figure 58:
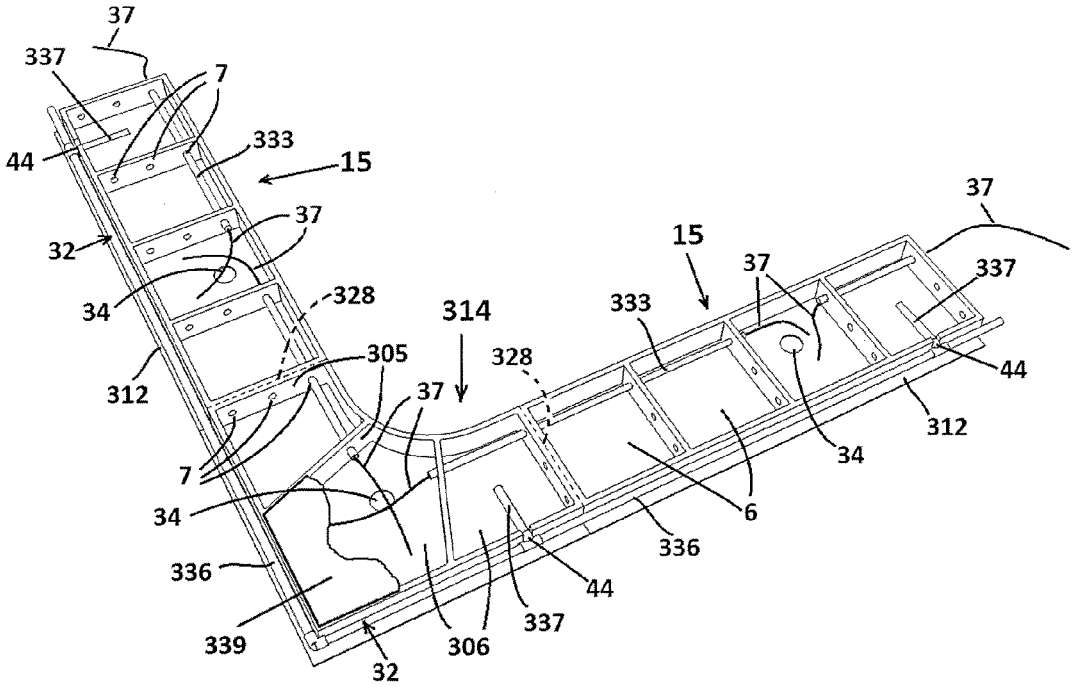
FIG. 58 is a top perspective view of an assembly of the corner module component of FIG. 52 with two straight modules, showing electrical and sprinkler system integration.

FIG. 58 is a top perspective view of an assembly of corner module 314 with two straight modules 15, showing electrical and sprinkler system integration. The modules are joined at joints 328, created by module attachments as shown in FIG. 57. In an exemplary embodiment, structural elements 5, 305 have apertures therethrough, including wire run access holes 7, which are used herein as conduit placement holes. In the illustrated embodiment, accessory cavities 6, 306 accommodate conduit raceways 333 for wiring 37. While electrical wiring 37 is specifically shown, it is understood that conduit raceways 333 may be used for other conduits, such as those for cable, internet access, phone service, and other signals, for example. In an exemplary embodiment, conduit raceways 333 are provided to protect and organize such conduits to minimize tangling; and prevent damage from unintentional contact by alignment pins, mechanical fasteners, and other objects. The provision of conduit raceways 333 also enhances ease of wiring after installation of the ceiling modules. In an exemplary embodiment, conduit raceways 333 are formed from ½ inch electrical metal tubing, but other sizes and materials are also suitable. Further protection is provided by cavity cover 339, a partial view of which is shown over accessory cavity 306 of corner module 314. In an exemplary embodiment, cavity cover 339 is formed from sheet metal, thereby rendering the covered cavity a conductor box.

FIG. 58 also shows fire sprinkler system 32, with supply lines 336 placed above trim edge 312 and branches 337 for sprinkler heads positioned through cut-outs 44 in accessory cavities 6, 306. System access holes 34 are also shown, which can also be used as light fixture installation holes. In the illustrated embodiment, sprinkler system branches 337 are not placed in the same accessory cavities 6, 306 as exposed wiring 37. While a particular arrangement of electrical, access and sprinkler system components is shown, it is contemplated that many variations in placement and installation of such components and other utility components is possible. For example, conduit raceways 333 of varying lengths may be positioned through any of the wire access holes 7. In some applications, it may be desirable to plug unused wire access holes 7.

Figure 59:
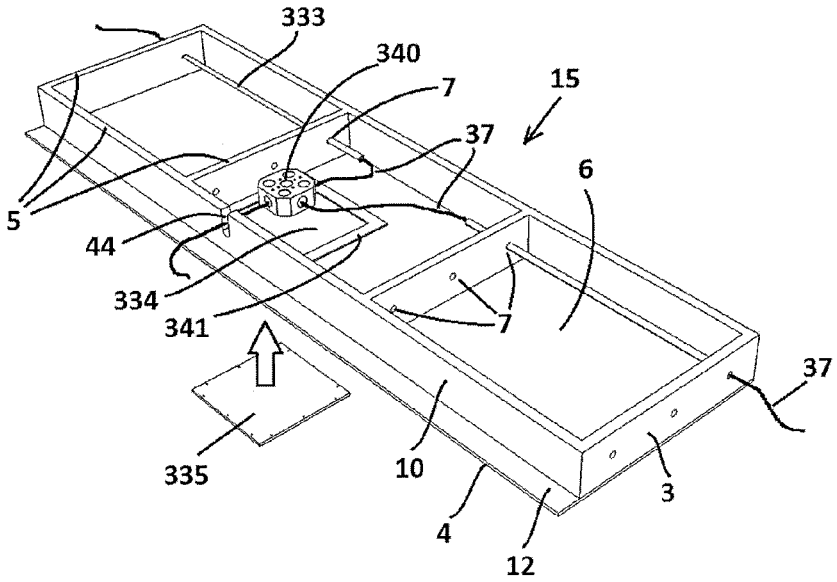
FIG. 59 is a top perspective view of a straight module, showing an electrical access panel.

FIG. 59 is a top perspective view of a straight module 15, showing an electrical access hole 334, through which one may access electrical junction box 340. In one embodiment, junction box 340 is attached to an existing ceiling (see FIG. 56) to which straight module 15 is also attached. In one embodiment, access hole 334 is edged with reinforcement 341 around its perimeter for strength. Materials such as sheet steel and one-quarter inch magnesium oxide board are suitable for use as reinforcement 341. At decorative major surface 4, access hole 334 is closed with an access hole cover 335, which is either installed with fasteners or glued in place and finished. In an exemplary embodiment, access hole cover 335 is formed from a panel of quarter-inch thick magnesium oxide or composite board. While the use of modules in a sculpted room system is illustrated as concealing electrical and sprinkler systems, the modules may also be used to attractively conceal components of heating and air-conditioning systems, plumbing systems, sound systems, security systems, and other utilities, for example.

Figure 60:
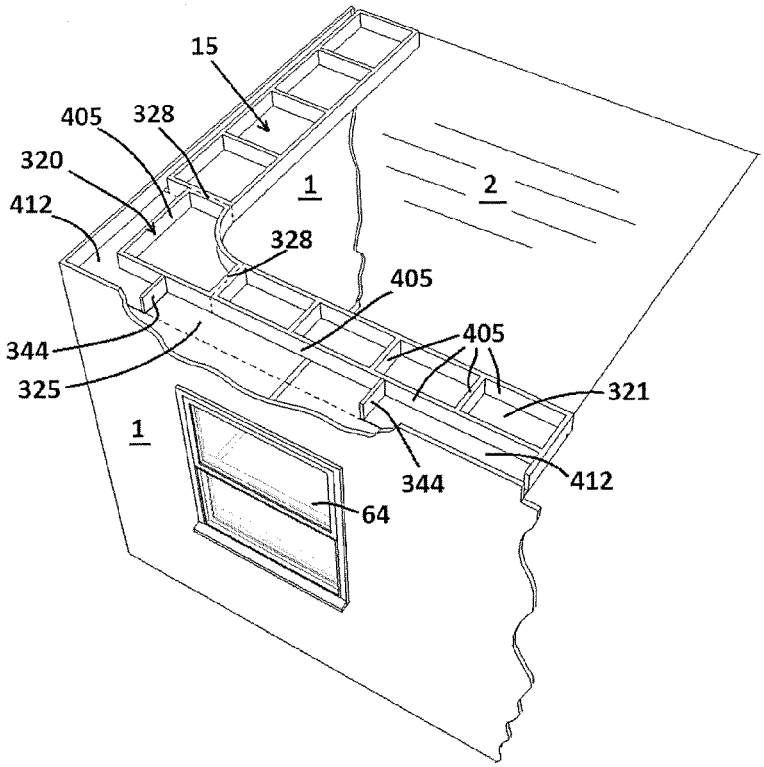
FIG. 60 is a top perspective of view another embodiment of corner and straight curtain modules in a ceiling installation.

FIG. 60 is a top perspective of view another embodiment of corner and straight curtain modules in a ceiling installation. Corner curtain module 320 is similar to corner module 314 except that structural elements 405 have been repositioned compared to structural elements 305 to allow for a larger trim edge 412, compared to trim edge 312. While no radial interior structural elements are shown on corner curtain module 321, radial or grid interior structural elements can be provided if desired. Straight curtain module 321 is similar to straight module 15 except that structural elements 405 have been repositioned compared to structural elements 5 to allow for a larger trim edge 412, compared to trim edge 12. A portion of trim edge 412 can be cut from each of corner curtain module 320 and straight curtain module 321 to correspond to a location above window 64. The cut material is removed to form a recessed curtain space 325 between structural elements 405 and existing wall 1 for the installation of a curtain rod. Finishing blocks 344, preferably formed of the same material as structural elements 405, are attached to trim edge 412 and structural elements 405 to close off ends of recessed curtain space 325. A suitable means for attachment of finishing blocks 344 to trim edge 412 and structural elements 405 is by adhering with an adhesive such as Super Calstik® adhesive commercially available from Industrial Insulation Group, LLC of Brunswick, Ga. This adhesive may also be used in other locations on the disclosed modules.

The finished effect is similar to that shown in FIG. 19. However, with the corner recessed curtain module 20 and straight recessed curtain module 21 shown in FIGS. 14A-19, the positioning of the recessed space was constrained by the locations and sizes of cut out cavities 41. In contrast, the corner curtain module 320 and straight curtain module 321 shown in FIGS. 60 and 61, with the use of finishing blocks 344, allow for the creation of recessed space 325 at any position and of any length along trim edge 412.

Figure 61:
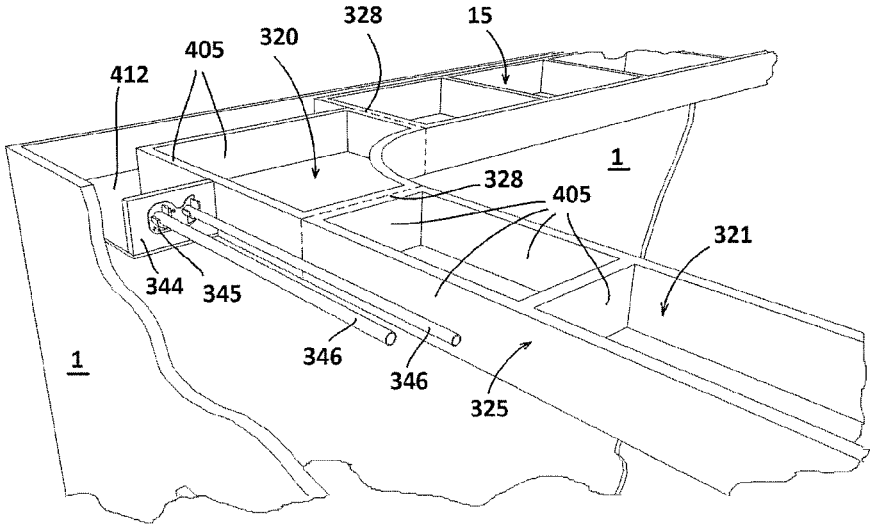
FIG. 61 is a side perspective of view a portion of FIG. 60, additionally showing installed curtain rods.

FIG. 61 is a side perspective of view a portion of FIG. 60, additionally showing curtain rod bracket 345 installed on finishing block 344. In an exemplary embodiment, curtain rod bracket 345 accommodates two curtain rods 346. Only a portion of each curtain rod 346 is shown; it is to be understood that in a typical application, each curtain rod 346 spans the length of the entire recessed curtain space 325 and is supported on both ends by brackets 345 attached to finishing blocks 344. Such a curtain rod installation effectively hides the curtain rods 346 from view and eliminates the need to install brackets or other curtain supporting hardware on the existing wall 1.

Figure 62:
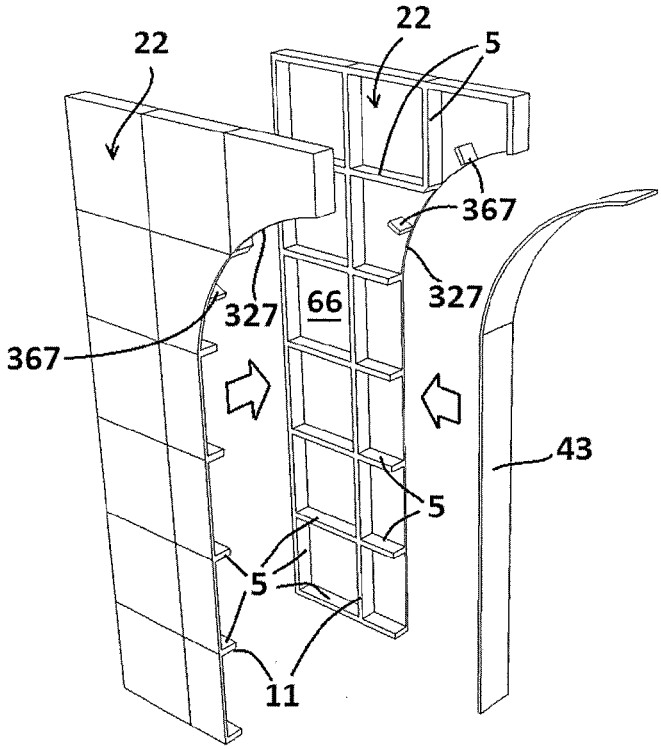
FIG. 62 is a side perspective view of another exemplary embodiment of an assembled part, showing the use of support blocks and a finishing strip.

FIG. 62 is a side perspective view of another exemplary embodiment of construction of a module assembly, such as for use as a room partition, showing the use of support blocks and a finishing strip. Attachment surfaces 11 of two minor-image design panels 22 are abutted and attached together, such as by the use of adhesive and/or mechanical fasteners. The finished effect of the assembled part is similar to that of FIG. 37 in that both figures show a room partition formed from modules that are attached to each other at their respective attachment surfaces 11. However, the embodiment of FIG. 62 offers more design flexibility than that of FIG. 37 because of the use of finishing strip or edging material 43. Rather than forming a partition with the exact dimensions of modules 14, 15, as shown in FIG. 37, the embodiment of FIG. 62 shows that a partition of any shape and size can be formed by cutting a design panel 22 into any desired shape. Support blocks 367 are installed on design panels 22 (such as by the use of adhesive and/or mechanical fasteners on interior surface 66) where structural elements 5 are absent but additional structural support is desired, especially proximate cut line 327. Moreover, support blocks 367 provide additional attachment points for the attachment of edging material 43. Edging material 43 is attached to support blocks 367 and structural elements 5 at cut line 327 to provide a finished edge surface for the partition assembly. In an exemplary embodiment, edging material 43 is a half-inch thick gypsum finishing material. While a single cut design module 22 is shown in FIG. 62 for each side of the partition assembly, it is also contemplated that multiple modules may be assembled to form each side of a partition assembly, such as is shown in FIG. 37. As shown in FIG. 37, the finished assembly may be attached to an existing wall 1 and/or existing ceiling 2. Moreover, a finished assembly may be attached to a wall and/or ceiling modified by the system components described herein.

Figure 63:
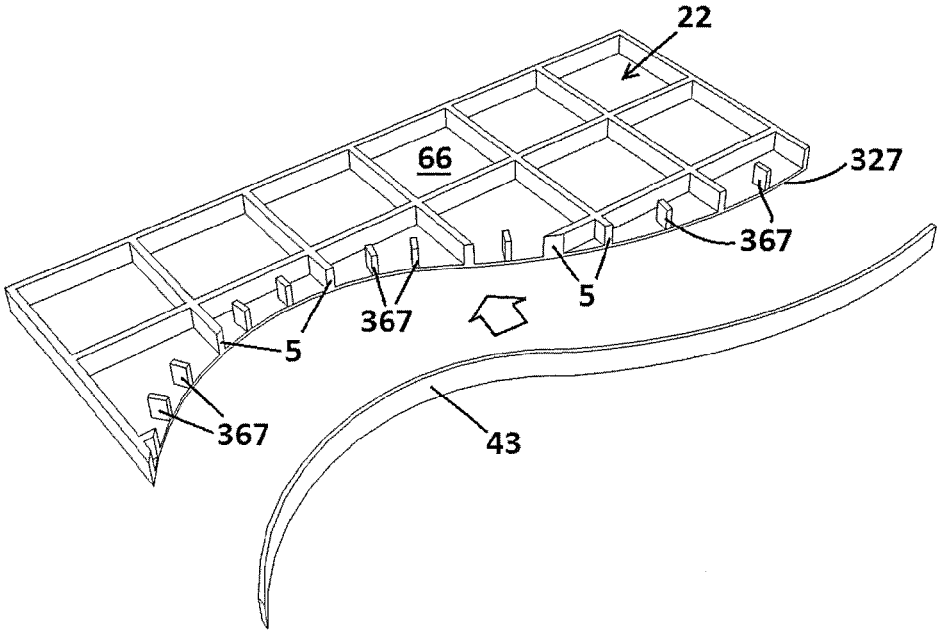
FIG. 63 is a top perspective view of another exemplary embodiment of a designed module, showing the use of support blocks and a finishing strip.

FIG. 63 is a top perspective view of another exemplary embodiment of a design module 22, showing the use of support blocks 367 and an edging material finishing strip 43. The finished effect of the design module 22 is similar to that of FIGS. 45 and 46. However, in the embodiment of FIG. 63, support blocks 367 are installed (such as by the use of adhesive and/or mechanical fasteners on interior surface 66) where structural elements 5 are absent but additional structural support is desired. Moreover, support blocks 367 provide additional attachment points for the attachment of edging material 43. Edging material 43 is attached to support blocks 367 and structural elements 5 at cut line 327 to provide a finished edge surface for the partition assembly. In this embodiment, edging material 43 need not have the positioning tabs 45 of finishing strip 56 of FIG. 47.

Figure 64:
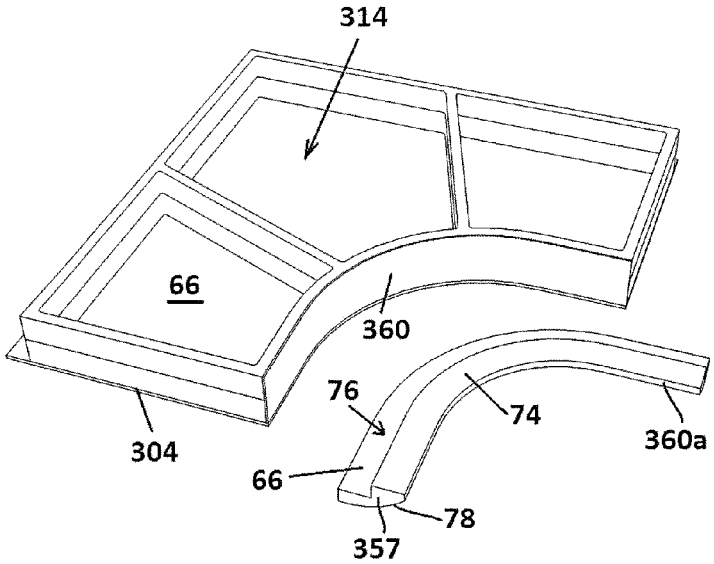
FIG. 64 is a top perspective view of the corner module component of FIG. 52 with an extension for modification to accept recessed lighting.

FIG. 64 is a top perspective view of corner module 314 with a component extension 357 for modification of corner module 314 to accept recessed lighting. In an exemplary embodiment, extension 357 is a foam part that is adhered to curved edge surface 360 to form a modified corner module 314 that is similar to corner module 214 of FIGS. 48-51, a primary difference being in the configuration of the structural elements and accessory cavities. In an exemplary embodiment, along the outer edge of component extension 357, a rim 74 (e.g., such as a one-inch high rim) projects upward from interior surface 66. The positioning of rim 74 forms an accessory cavity or channel 76 between rim 74 and the curved edge surface 60 of the corner module 314. Accessory cavity 76 is especially suitable for placement of a "hidden" light-emitting diode (LED) lighting strip (not shown) intended to project light over the rim 74 and onto the ceiling and create an indirect lighting effect. The design of modified corner module 314 also includes a dramatic shallow radius 78 that extends contiguously from the decorative major surface 304 to the outer perimeter decorative edge surface 360*a* of the component extension 357. This concept is not limited to a corner module and may be incorporated in any components of the disclosed sculpted room system.

Figure 65:
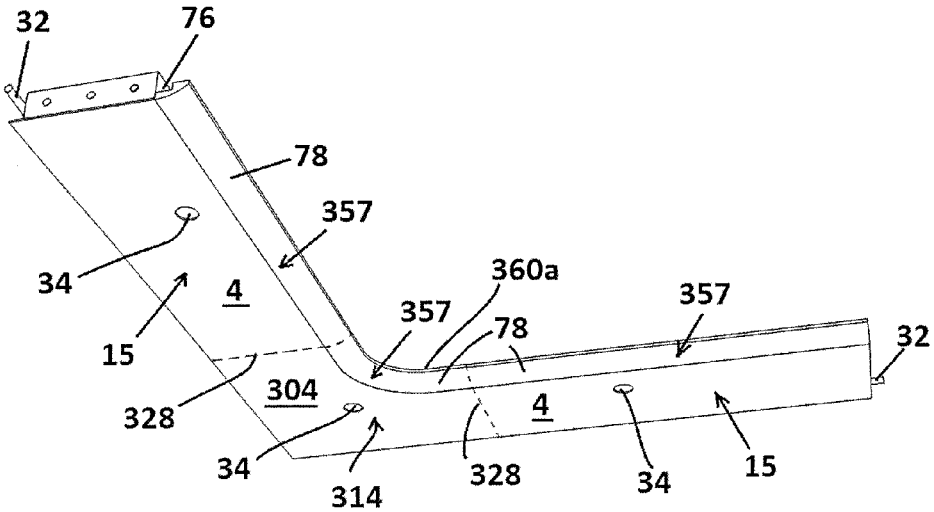
FIG. 65 is a bottom perspective view of the modified corner module component of FIG. 64, along with similarly modified straight components, in a ceiling installation.

FIG. 65 is a bottom perspective view of the modified corner module component of FIG. 64, along with similarly modified straight components, in a ceiling installation. In the illustrated embodiment, the modified modules 314, 15 are able to accommodate indirect lighting in accessory cavity 76 as well as direct lighting installed at access holes 34.

While a particular construction of a module of an exemplary interior design modification system is illustrated and disclosed, it is contemplated that other construction methods and materials can be used to achieve modules with the described structural configurations. For example, the structural elements or layers can be formed of cut materials, molded materials, and/or connected beams made of materials such as wood, cork, foam, plastic and laminated elements comprising combinations of materials.

In an exemplary embodiment, once one or more components of a finished sculpted room design are mounted, any cut surface forming a final decorative surface or opening on a final decorative surface (and, if desired, any surface discontinuity thereon) is finish coated with ignition barrier material. As noted above, finishing is completed as desired; for instance, the final decorative surface of a sculpted room design may be painted or otherwise aesthetically (for example, covered with a laminate such as wallpaper, paneling, or textured).

Figure 66:
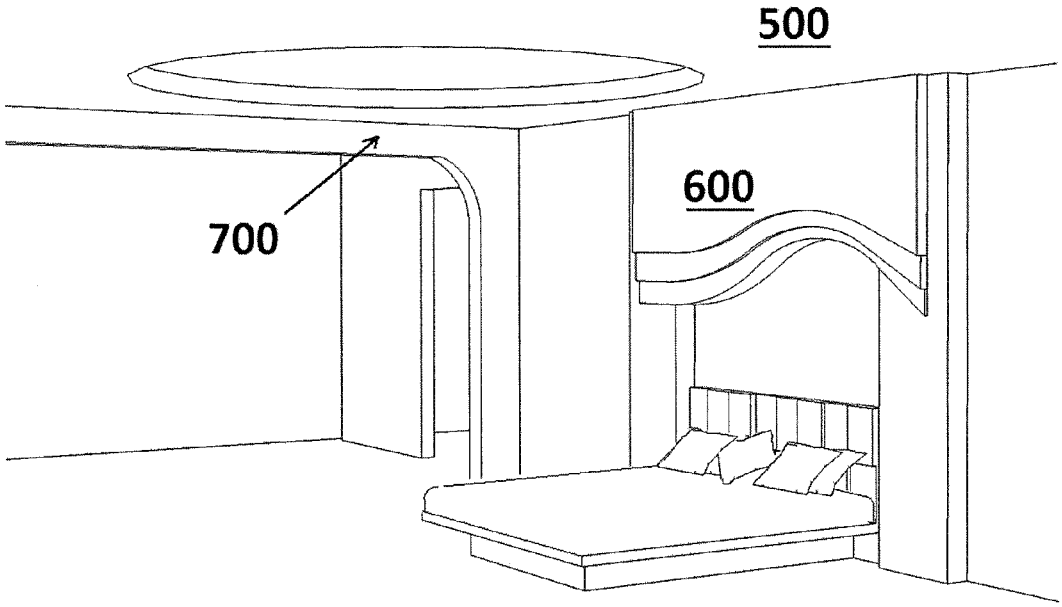
FIG. 66 is a perspective view of a room featuring disclosed system components in ceiling, wall, and partition installations.

FIG. 66 is a perspective view of a room featuring disclosed system components in a ceiling installation 500, a wall installation 600, and a partition installation 700. In particular, wall installation 600 includes a variable depth effect formed by layering a number of disclosed module components. Such a layering effect can also be used on ceiling and partition installations. A layered effect on a ceiling is shown FIG. 28 and described with reference to FIG. 28.

Although the sculpted room system disclosed herein has been described with respect to several embodiments, workers skilled in the art will recognize that changes may be made in form and detail without departing from the spirit and scope of this disclosure. In addition, any feature disclosed with respect to one embodiment may be incorporated in another embodiment, and vice-versa.

What is claimed is:

1. A system comprising a plurality of modules configured for attachment to a mounting surface, a first module of the plurality of modules comprising:

a panel having a decorative major surface disposed opposite an interior surface, the panel comprising a plurality of edges that form a closed shape; and a plurality of structural elements extending from the interior surface, wherein the plurality of structural elements comprises:

a first structural element disposed proximate and parallel to a first edge of the plurality of edges;

a second structural element disposed proximate and parallel to a second edge of the plurality of edges;

wherein the first and second structural elements meet at a right angle, and a third structural element that does not intersect the first or second structural element at the right angle, wherein the third structural element is spaced from all edges of the panel that are parallel to the third structural element;

wherein an attachment surface of the plurality of structural elements is positioned opposite the interior surface, and wherein the attachment surface is configured to abut the mounting surface or to abut an attachment surface of another module for attachment thereto.

2. The system of claim 1 wherein at least two modules of the plurality of modules are configured for adjacent attachment to the mounting surface so that their decorative major surfaces are co-extensive at a joint between the two modules.

3. The system of claim 1 wherein at least one of the plurality of structural elements is curved.

4. The system of claim 3 wherein the third structural element extends generally radially from the at least one of the plurality of structural elements that is curved.

5. The system of claim 3 wherein the first module comprises magnesium oxide.

6. The system of claim 1 wherein the first module comprises at least two cavities that are identically sized.

7. The system of claim 1 further comprising an extension configured for attachment to the first module to form a modified first module so that a first surface of the extension is contiguous with the decorative major surface of the first module.

8. The system of claim 7 wherein the first surface is curved.

9. The system of claim 7 wherein the modified first module comprises a channel between one of the plurality of structural elements and a rim of the extension.

10. A method of creating a room partition, the method comprising:

providing a first module comprising:

a first panel having a first decorative major surface disposed opposite a first interior surface; and a first structural element extending from the first interior surface and at least partially bordering a first cavity, wherein a first attachment surface is a surface of the first structural element opposite the first interior surface; and abutting a second attachment surface of a second module to the first attachment surface and attaching the second module to the first module, the second module comprising:

a second panel having a second decorative major surface disposed opposite a second interior surface; and a second structural element extending from the second interior surface and at least partially bordering a second cavity, wherein the second attachment surface is a surface of the second structural element opposite the second interior surface.

11. The method of claim 10 wherein the room partition is further attached to a mounting surface of a room.

12. The method of claim 11 wherein the mounting surface is a ceiling or wall.

13. The method of claim 10 further comprising:

cutting the first module into a first configuration at a first cut line; and cutting the second module into a second configuration that is a minor image of the first configuration at a second cut line.

14. The method of claim 13 further comprising attaching an edging material to the first and second modules at the first and second cut lines.

15. The method of claim 14 further comprising attaching at least one support block to each of the first and second panels proximate each of the first and second cut lines.

16. A method of modifying a mounting surface of a room, the method comprising:

abutting a first attachment surface of a first module to the mounting surface and attaching the first module to the mounting surface, the first module comprising:

a first panel having a first decorative major surface disposed opposite a first interior surface, and the first panel comprising a plurality of edges that form a closed shape; and a first plurality of structural elements extending from the first interior surface and at least partially bordering a first cavity, wherein the first attachment surface is a surface of the first plurality of structural elements opposite the first interior surface; wherein the first plurality of structural elements comprises:

a first structural element disposed proximate and parallel to a first edge of the plurality of edges;

a second structural element disposed proximate and parallel to a second edge of the plurality of edges;

wherein the first and second structural elements meet at a right angle, and a third structural element that does not intersect the first or second structural element at the right angle, wherein the third structural element is spaced from all edges of the first panel that are parallel to the third structural element.

17. The method of claim 16 further comprising:

abutting a second attachment surface of a second module to the first decorative major surface and attaching the second module to the first module, the second module comprising:

a second panel having a second decorative major surface disposed opposite a second interior surface; and a second plurality of structural elements extending from the second interior surface and at least partially bordering a second cavity, wherein the second attachment surface is a surface of the second plurality of structural elements opposite the second interior surface.

18. The method of claim 16 further comprising:

abutting a second attachment surface of a second module to the mounting surface and attaching the second module to the mounting surface, the second module comprising:

a second panel having a second decorative major surface disposed opposite a second interior surface; and a second plurality of structural elements extending from the second interior surface and at least partially bordering a second cavity, wherein the second attachment surface is a surface of the the second plurality of structural elements opposite the second interior surface;

wherein the second module is attached to the mounting surface adjacent the first module so that the second decorative major surface is co-extensive with the first decorative major surface at a joint between the first module and the second module.

19. The method of claim 18 further comprising positioning an alignment pin at the joint.

* * * * *